US010870140B2

(12) United States Patent
Pingilley et al.

(10) Patent No.: US 10,870,140 B2
(45) Date of Patent: Dec. 22, 2020

(54) SYSTEMS AND METHODS FOR ELECTROPROCESSING A GUN BARREL USING A MOVING ELECTRODE

(71) Applicant: GOVERNMENT OF THE UNITED STATES, AS REPRESENTED BY THE SECRETARY OF THE ARMY, Washington, DC (US)

(72) Inventors: John D. Pingilley, Bettendorf, IA (US); Amanda L. Badger, Eldridge, IA (US); Dale A. Phipps, Taylor Ridge, IL (US)

(73) Assignee: Government of the United States, as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/385,790

(22) Filed: Apr. 16, 2019

(65) Prior Publication Data

US 2019/0314879 A1 Oct. 17, 2019

Related U.S. Application Data

(62) Division of application No. 16/384,109, filed on Apr. 15, 2019.

(Continued)

(51) Int. Cl.
*F41A 21/22* (2006.01)
*B21C 37/15* (2006.01)

(Continued)

(52) U.S. Cl.
CPC ..... *B21C 37/152* (2013.01); *F41A 21/02* (2013.01); *F41A 21/18* (2013.01); *F41A 21/22* (2013.01)

(58) Field of Classification Search
CPC ..... F41A 21/487; F41A 21/44; F41A 21/22

(Continued)

(56) References Cited

U.S. PATENT DOCUMENTS 2,425,359 A * 8/1947 Zavarella ..... C25D 5/16 204/272
3,645,881 A 2/1972 Williams (Continued)

FOREIGN PATENT DOCUMENTS

CN 106048693 A 10/2016
CN 106319610 A 1/2017

(Continued)

OTHER PUBLICATIONS

STAC6 Data Sheet; Applied Motion Products; Watsonville, CA; Version 925-0012 Rev. B; obtained Jun. 14, 2017; seven (7) pages.

(Continued)

*Primary Examiner* — Stephen Johnson
(74) *Attorney, Agent, or Firm* — Gregore P. Gibson

(57) ABSTRACT

A guide system for use in electro-processing a bore of a gun barrel includes a non-conductive external bore guide and a non-conductive internal bore guide. The external bore guide is an adapter that is configured to removably engage the outside of the gun barrel and includes a conduit formed therein. The conduit is disposed such that it is axially aligned with a bore of the gun barrel when the external bore guide is engaged with the gun barrel. The internal bore guide is elongated and includes an axial recess that is sized to seat an electro-processing electrode (an anode). A method for uniformly plating the bore includes moving an anode through the gun barrel at one or more rate(s) of travel to uniformly plate the bore is also disclosed. The plating is sufficiently uniform to conform to military specifications. The systems, (Continued)

methods, support structures, etc. described herein are particularly well-suited to plating small-bore gun barrels.

18 Claims, 17 Drawing Sheets

Related U.S. Application Data

(60) Provisional application No. 62/658,945, filed on Apr. 17, 2018, provisional application No. 62/658,955, filed on Apr. 17, 2018.

(51) Int. Cl.
*F41A 21/18* (2006.01)
*F41A 21/02* (2006.01)

(58) Field of Classification Search
USPC ..... 89/14.8; 42/76.02, 76.1
See application file for complete search history.

(56) References Cited

U.S. PATENT DOCUMENTS

| | | | | |
|---|---|---|---|---|
| 4,130,467 | A * | 12/1978 | Oehr | C25B 11/16 205/143 |
| 4,690,737 | A | 9/1987 | Vishnitsky | |
| 4,772,367 | A | 9/1988 | Menzel et al. | |
| 4,846,940 | A | 7/1989 | Neuhauser et al. | |
| 5,476,581 | A | 12/1995 | Reckeweg et al. | |
| 5,958,195 | A | 9/1999 | Lorincz et al. | |
| 6,277,264 | B1 | 8/2001 | Lorincz | |
| 6,402,908 | B1 | 6/2002 | Lorincz | |
| 6,428,681 | B1 | 8/2002 | Lorincz | |
| 6,461,486 | B2 | 10/2002 | Lorincz et al. | |
| 6,547,950 | B1 | 4/2003 | Lorincz | |
| 6,562,216 | B2 | 5/2003 | Schlenkert et al. | |
| 6,594,936 | B1 | 7/2003 | Sniezak et al. | |
| 6,660,138 | B2 | 12/2003 | Lin et al. | |
| 6,660,156 | B2 | 12/2003 | Lorincz | |
| 6,712,668 | B2 | 3/2004 | Lorincz | |
| 2002/0061241 | A1 * | 5/2002 | Fischer | B42C 9/0012 412/37 |
| 2012/0205249 | A1 * | 8/2012 | Inoue | C25D 3/665 205/143 |
| 2017/0298531 | A1 | 10/2017 | Mukaiyama et al. | |
| 2018/0016688 | A1 | 1/2018 | Angelini | |

FOREIGN PATENT DOCUMENTS

| | | | |
|---|---|---|---|
| JP | S63190194 | A | 8/1988 |
| KR | 101365747 | B1 | 2/2014 |
| RU | 2530218 | C2 | 10/2014 |

OTHER PUBLICATIONS

MIL-STD-171F; "Finishing of Metal and Wood Surfaces"; Department of Defense Manufacturing Process Standard; May 31, 2011; 65 pages.

Jarrett, W. J.; "Development of a Stellite-Lined, Chromium-Plated Barrel for 5.56MM Machine Gun"; Report No. SA-TR1-7025; Springfield Armory; Springfield, Massachusetts; Jun. 30, 1967; 47 pages.

Vincent, T. K.; "Development of Chrome Plating of Guns"; No. BRL-87; U.S. Army Ballistic Research Lab; Aberdeen Proving Ground, MD; Nov. 1937; 40 pages.

Bish, Joseph M. and Rowe, John D.; "Automated Chromium Plating Line for Gun Barrels"; Engineering Directorate, Rock Island Arsenal; Rock Island, IL; Sep. 1979; 32 pages.

Weisselberg, Arnold; "Distribution of Current Along a Cylindrical Anode Inside of a Concentric Tube with Application to Chromium Plating"; Journal of the Electrochemical Society 90.1; Oct. 17, 1946; pp. 235-245.

Spivak, M. S.; "A Determination of the Distribution of Chromium Plate in the Bores of Small Arms Barrels"; Springfield Armory; Report SA-TR18-1070; Feb. 12, 1960; 22 pages.

* cited by examiner

SYSTEMS AND METHODS FOR ELECTROPROCESSING A GUN BARREL USING A MOVING ELECTRODE

CROSS-REFERENCE TO RELATED APPLICATIONS

This application is a division of co-pending U.S. patent application Ser. No. 16/384,109, filed Apr. 15, 2019 by at least one common inventor, which is incorporated by reference herein in its entirety. This application also claims the benefit of U.S. Provisional Patent Application Ser. No. 62/658,945, filed on Apr. 17, 2018, by at least one common inventor, which is also incorporated by reference herein in its entirety. This application also claims the benefit of U.S. Provisional Patent Application Ser. No. 62/658,955, filed on Apr. 17, 2018, by at least one common inventor, which is also incorporated by reference herein in its entirety.

GOVERNMENT INTEREST

The inventions described herein may be made, used, or licensed by or for the U.S. Government for U.S. Government purposes without payment of royalties to me.

BACKGROUND OF THE INVENTION

Field of the Invention

The present invention relates generally to electrochemical processing and, more particularly, to electrochemically processing small-bore gun barrels. Even more particularly, the invention relates to systems and methods for electroplating a small-bore gun barrel using a moving anode and guide system.

Description of the Background Art

Electroplating the bores of small-bore gun barrels is known. For example, applying a thin layer of chromium (chrome) to the bore of a barrel is desirable, because chrome is very hard. The chrome plating improves wear resistance of the bore and, thus, increases the number of projectiles that the gun barrel can discharge in its lifetime. Chrome plating also has the advantage of adding a corrosion-resistant coating to the bore, which increases the life of the barrel, especially in humid environments. Small-bore gun barrels are considered to be those having bores of approximately 50 caliber (0.500 inch diameter) and less.

One known method for plating the bore of a small-bore gun barrel includes placing a long anode wire through the entire length of the bore. Chromium electrolyte solution is then pumped through the bore while voltages are applied to the anode and gun barrel, respectively. Current flowing from the anode to the bore via the electrolyte causes a thin chrome layer to be deposited on the bore's surface.

A significant drawback of known plating methods is that they are incapable of reliably depositing a layer of material on the surface of a bore that is sufficiently uniform in thickness and quality to meet strict military specifications (e.g., MIL-STD-171F, Finish No. 1.2.2 for chrome) or other plating specifications associated with high-accuracy barrels. Because plating is done after barrel rifling is formed, non-uniformities in the plating's thickness and/or quality (e.g., waviness, pits, lumps, cracks, etc.) readily cause projectile inaccuracy. Thus, existing plating techniques yield an unacceptably large percentage (commonly 20-25%) of barrels that do not meet plating specifications and must be reworked, which significantly increases production costs. Accordingly, it is often the case that small-bore barrels remain unplated so that they shoot more accurately. Unfortunately, they also wear out faster and must be replaced more often.

SUMMARY OF THE INVENTION

The present invention overcomes the problems associated with the prior art by providing systems and methods for uniformly plating small-bore gun barrels. Because the plating is more uniform in thickness and quality, the accuracy of the barrel is maintained and the plating conforms to military standards. Accordingly, the number of barrels that must be rejected and/or reworked is significantly reduced. Additionally, the invention facilitates customized plating to be readily implemented.

A system for electro-processing a bore of a gun barrel according to an exemplary embodiment of the present invention includes an electrode (e.g., an anode) having a length less than a length of the bore, a lead electrically coupled to the electrode, a barrel end adapter, and an actuator. The barrel end adapter is configured to removably engage a first end of the gun barrel. The barrel end adapter also defines a conduit therethrough that is axially aligned with the bore when the barrel end adapter is engaged with the gun barrel. The actuator is coupled to the lead and is operative to move the electrode through the bore and the conduit by moving the lead during electro-processing.

A barrel end adapter according to an exemplary embodiment of the present invention includes a non-conductive body, a conduit formed in the non-conductive body and defining an axis through the body, and a barrel interface. The barrel interface is configured to removably engage a distal end of a gun barrel to temporarily affix the barrel end adapter to the gun barrel. Additionally, the conduit is axially aligned with a bore when the barrel interface is engaged with the distal end of the gun barrel. A bore guide according to an exemplary embodiment of the present invention includes an elongated, non-conductive body and a passage formed axially through the non-conductive body. The body has a top surface, a bottom surface, and a plurality of sides between the top and the bottom surfaces. The passage is formed through the elongated body from an opening defined by the top surface to an opening defined by the bottom surface. Additionally, the passage is sized to closely accept an electro-processing electrode therein through at least one of the opening defined by the top and the bottom surfaces. A remainder of the passage is sized to pass an electrical lead coupled to the electro-processing electrode.

An exemplary method for electro-processing a bore of a gun barrel includes steps of providing a gun barrel having a bore defining an axis, providing an electrode having a lead electrically coupled thereto, providing a barrel end adapter defining a conduit therethrough, temporarily affixing the barrel end adapter to a first end of the gun barrel such that the conduit is axially aligned with the bore, positioning the electrode within the bore, positioning the gun barrel in electro-processing solution, moving the electrode within at least one of the bore and the conduit, and applying process current via the electrode during the step of moving the electrode to cause electro-processing of the bore. The length of the lead is shorter than the length of the bore.

A guide system for use in electro-processing a gun barrel according to an exemplary embodiment of the invention includes a non-conductive external bore guide and a non-conductive internal bore guide. The external bore guide is an adapter that is configured to removably engage the outside of the gun barrel and includes a conduit formed therein. The conduit is disposed such that it is axially aligned with a bore of the gun barrel when the external bore guide is engaged with the gun barrel. The internal bore is elongated and includes an axial recess that is sized to seat an electro-processing electrode (an anode). Utilizing the external and internal bore guides, the anode can be pulled through the gun barrel at one or more rate(s) that provide uniform plating of the bore. The plating is sufficiently uniform to conform to military specification.

BRIEF DESCRIPTION OF THE DRAWINGS

The present invention is described with respect to the following figures, wherein like reference numbers indicate substantially-similar elements.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art how to variously employ the present invention. In other instances, details of well-known components and manufacturing practices (e.g., molding, 3D printing, metal fabrication and assembly, actuator control, regulator control, etc.) have been omitted so as to avoid unnecessarily obscuring the present invention.

Figure 1:
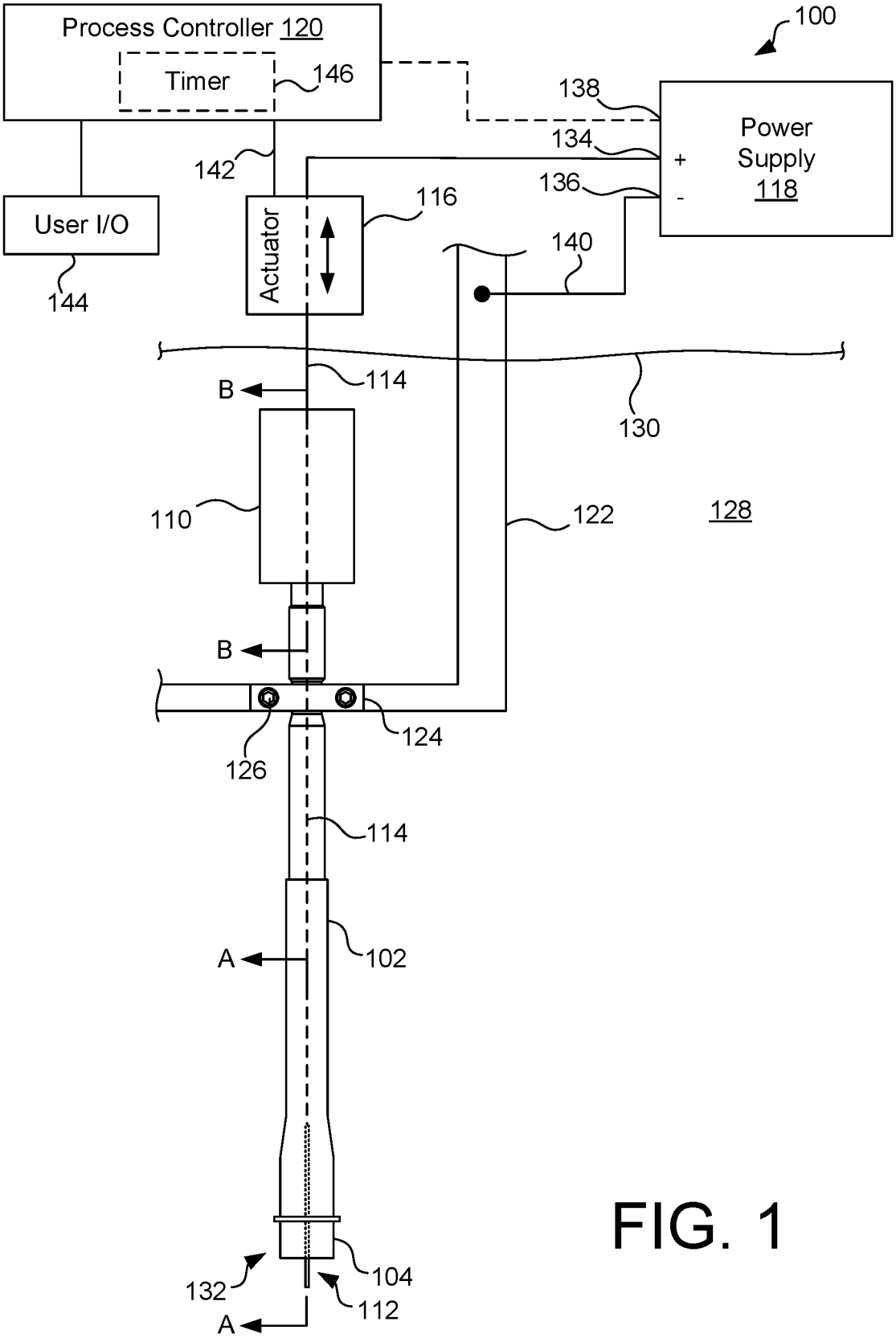
FIG. 1 is a block diagram showing an electro-processing system according to an exemplary embodiment of the present invention.

FIG. 1 is a block diagram showing an electro-processing system 100 according to an exemplary embodiment of the present invention. Here, electro-processing system 100 is being used to electroplate a small-bore gun barrel 102. Barrel 102 is for a model M16 rifle in this embodiment and, therefore, includes a barrel extension 104 attached thereto as is well-known. Barrels for other guns might not include a barrel extension.

System 100 includes a barrel end adapter 110, a moving electrode (anode)assembly 112 having a conductive lead 114 electrically coupled thereto, an electrode mover (actuator) 116, a power supply 118, a process controller 120, and a support structure 122. Support structure 122 includes a clamping member 124, which secures barrel 102 to support structure 122 when fastener(s) 126 are engaged therewith. Support structure 122 holds barrel 102 substantially vertically, but submerged, within a tank (vat) 128 of electrolyte solution 130 (e.g., hexavalent chromium solution, etc.) so that the electrolyte fills the bore (not shown in FIG. 1) of barrel 102. Support structure 122 is shown generally representationally here and it should be understood that other support structures 122 can be employed.

Barrel end adapter 110 functions as an external (to barrel 102) electrode guide that is temporarily affixed to the muzzle end of barrel 102. Lead 114 is positioned through a conduit (FIGS. 5A-5D) formed in barrel end adapter 110 and through the bore of barrel 102 so as to move (e.g., pull) anode assembly 112 therethrough. Electrode mover 116 comprises an actuator (e.g., a linear actuator, servo motor, rack and gear, etc.) that is coupled to lead 114 and functions to move lead 116, and thus anode assembly 112, through gun barrel 102 under the control of process controller 120 in the directions of the arrow shown. In this embodiment, actuator 116 draws anode assembly 112 through barrel 102, beginning at its chamber end 132, and continuing up barrel 102 through barrel end adapter 110 during electroplating. Process controller 120 is electrically coupled to actuator 116 and controls the rate at which actuator 116 moves lead 114. Actuator 116, in turn, moves anode assembly 112 by pulling lead 114 at rate(s) specified by process controller 120. In other embodiments, electroplating can start at the muzzle end and proceed to the chamber end, etc.

Power supply 118 provides process current for electro-processing system 100. Power supply 118 includes a first power supply terminal 134, a second power supply terminal 136, and an optional control input set 138. First power supply terminal 134 is electrically coupled to conductive lead 114 and is operative to assert first (e.g., positive) voltage(s) on anode assembly 112. Second power supply terminal 136 is electrically coupled to support structure 122 via a second lead 140 and associated connecting mechanism (s) (e.g., a terminal post, clamp, etc.) such that power supply 118 can assert second (e.g., negative) voltage(s) on gun barrel 102 via support structure 122. Accordingly, during electroplating, current flows from anode assembly 112 to barrel 102 via electrolyte 130 causing plating material to be deposited on the surface of the bore of barrel 102 as anode assembly 112 moves therethrough.

In the present embodiment, power supply 118 comprises a rectifier capable of providing an amount of current sufficient to maintain a predetermined current density during electroplating. Control input set 138 thus enables process controller 120 to specify a desired current (or current density) for power supply 118 to maintain. In an alternative mode of operation, power supply 118 can be configured to maintain predetermined voltages on terminals 134 and 136. In still other embodiments, a human operator can set the operational parameters of power supply 118 directly.

Process controller 120 provides overall control of the electro-plating process of gun barrel 102. For example, process controller 120 can, via control input set 138, instruct power supply 118 to provide process power with the desired characteristics. Process controller 120 can also instructs actuator 116, via a control path 142, to lengthen or retract lead 114 to position anode assembly 112 relative to barrel 102, to pull lead 114 at a specified rate, etc. Process controller 120 further includes a user input/output (I/O) 144 so the user can specify process current/voltages, anode draw rate(s), the type/length of barrel 102, start and/or stop processing commands, etc. Processor controller 120 is shown to further include a timer 146, which provides time information/signals and enables process controller 120 to control the rate of travel of anode assembly 112 via actuator 116, to determine regional and/or aggregate plating time(s), etc. Process controller 120 can be implemented in hardware (e.g., in an integrated circuit, firmware, EEPROM, etc.), in software (e.g., stored or running in memory of a computer), etc. or some combination thereof. In a particular embodiment, process controller 120 comprises a STAC6-Si programmable driver by Applied Motion Products.

The inventors have determined that the non-uniformity of prior art chrome plating is caused by several factors. First, with respect to the prior art system discussed, the voltage on the anode varies significantly along its length, and this voltage variation induces a corresponding variation in the thickness of the chrome layer along the length of the bore. Second, bubbles (e.g., evolved hydrogen gas, etc.) are generated in the electrolyte as a by-product of the electro-processing. Such bubbles reduce contact between the electrolyte and the bore surface and interfere with current flowing between the anode and barrel, which in turn, causes thickness and quality variation of the plating. Third, even small variations in the prior machining (e.g., rifling formation, etc.) and cleaning of barrel 102 in preparation for plating can affect how the plating is deposited and can render the applied plating out of specification.

The electro-processing systems of the present invention overcome these drawbacks, because the rate(s) at which anode assembly 112 moves through the bore of gun barrel 102 is controlled by actuator 116 and process controller 120. As a result, chrome plating is deposited on the portions of bore adjacent to the anode for a time that yields a desired thickness of chrome plating (e.g., 0.0005 to 0.001 inches, etc.) plus or minus a predetermined tolerance (e.g., +/−5%, etc.) that maintains plating with specifications for accuracy, etc. Additionally, because bubbles are only generated near the plating length of the anode assembly 112, which is small relative to the overall length of the bore, the amount of bubbles within the bore are reduced and flow readily upward out of the plating area. Moreover, because the plating time can be adjusted within different regions of barrel 102, the present invention enables the plating process to be easily adapted to any changes in barrel production. As a result, the present invention enables a layer of chrome plating with the desired thickness and high quality (e.g., reduced or eliminated waviness, pits, lumps, cracking, etc.) to be applied to the bore of barrel 102. Even more advantageously, the chrome plating meets military specification such that significantly fewer barrels require reworking.

Figure 2:
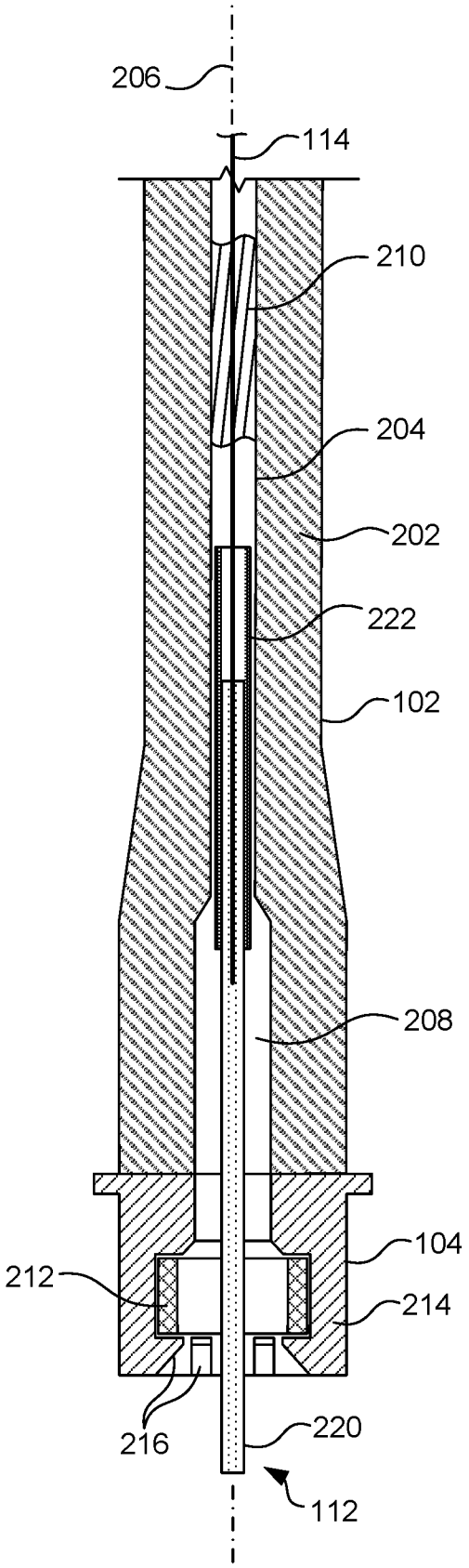
FIG. 2 is a cross-sectional view of the barrel of FIG. 1 taken along line A-A.

FIG. 2 is a cross-sectional view of a portion of barrel 102 taken along line A-A in FIG. 1. Barrel 102 includes a body 202 and a generally-cylindrical bore 204 formed axially through body 202 along an axis 206. Barrel 102 also includes a chamber 208, which receives a cartridge therein (not shown) so as to position the cartridge's projectile relative to bore 204. Bore 204 includes rifling 210 (lands and grooves) formed thereon as is well known. Rifled bore 204 may thus be described by both a land diameter and a groove diameter. The land diameter is often referred to by those skilled in the art as the "bore" diameter and corresponds to the diameter across the lands (high points) in the rifling. The groove diameter, by contrast, corresponds to the diameter across the grooves (low points) in the rifling and is, therefore, slightly larger than the land diameter. Therefore, unless otherwise stated, references to the "diameter" of bore 204 made herein can mean the land diameter, the groove diameter, or both as the case may be.

Barrel extension 104 is attached to barrel 102 using well-known means (e.g., threads, pin, etc.; not shown), and forms a distal end of chamber 208. When a barrel extension 104 is used, as in the case of M16 barrels, it can be desirable for plating not to be applied to areas within the barrel extension 104 (e.g., so as to not interfere with operation of the bolt carrier group, etc.) Accordingly, an extension shield 212 is provided and covers the interior portions of barrel extension 104 to which plating is not to be applied. Here, barrel extension 104 comprises a generally-cylindrical sidewall 214 and a plurality of chamfered ribs 216 extending radially-inward therefrom. Extension shield 212 covers the inside of cylindrical sidewall 214 and is retained by ribs 216.

FIG. 2 also shows anode assembly 112 in greater detail to include an electrode 220 and a non-conductive bore guide 222 coupled to electrode 220. Electrode 220 is also electrically coupled to conductive lead 114. As anode assembly 112 is drawn through bore 204, bore guide 222 prevents electrode 220 from contacting the sides of bore 204 and chamber 208, including the portion of chamber 208 formed by barrel extension 104. During electroplating, current provided by lead 114 flows through the plating length of anode 220 (the portion protruding from bore guide 222) to bore 204 via the intermediate electrolyte.

Figure 3:
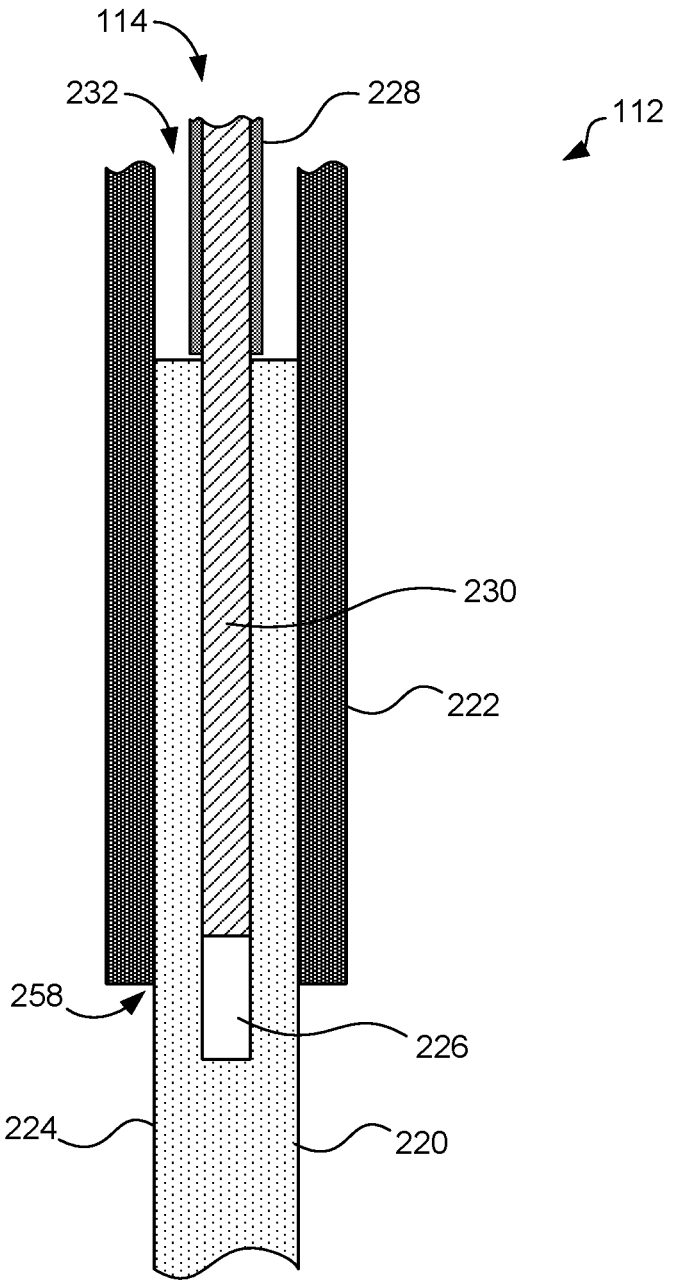
FIG. 3 is a cross-sectional view along line A-A showing the anode assembly of FIG. 2 in greater detail.

FIG. 3 is a cross-sectional view showing taken along line A-A (FIG. 1) showing anode assembly 112 in greater detail still. In particular, electrode 220 includes an elongated, cylindrical body 224 having an axial bore 226 formed therein. Lead 114 is coated in an insulating material 228 along its length, but includes a stripped end 230 that is secured (e.g., with conductive adhesive, interference fit, etc.) within bore 226 of electrode 220 such that electrode 220 can be electrified. Bore guide 222 also defines an axial passage 232, which closely accepts the electrode 220 therein and passes lead 114 therethrough to actuator 116. Bore guide 222 can be affixed to electrode 220 via an adhesive, interference fit, etc. between the outside of electrode 220 and axial passage 232. Notably, the combination of bore guide 222 and electrode 220 creates a rigid, elongate assembly that resists bending. This maintains the electrode-bore spacing throughout electro-processing, including when electrode assembly passes between bore 204 and the conduit 510 (FIG. 5B) of barrel end adapter 110.

In a particular embodiment, electrode 220 comprises a metal (e.g., copper, titanium, etc.) core that is coated (clad) in platinum. Such coated anode cores are commercially available from, for example, Anomet Products. Such commercially available anodes can be machined to form bore 226 therein. In another particular embodiment, the electrode body 224 has a diameter of 3.0 mm, which yields a muzzle standoff of around 1.27 mm to 1.35 mm (0.050 to 0.053 inches) and a chamber standoff of around 3.02 mm (0.119 inches) in the case of an M16 barrel. (Standoff indicates radial clearance between electrode 220 and bore 204 or chamber 208).

It should further be noted that the length of electrode 220 is much less than the length of bore 204. For example, in some embodiments, the length of electrode 220 is less than half the length of bore 204. In other embodiments, the length of electrode is less than 25% the length of bore 204. In the particular embodiment shown, the total length of electrode 220 is around 4 inches, and the active plating length (the portion that protrudes from bore guide 222) is around 3 inches, which means that the total length of anode 220 is approximately equal to 20% of the length of an M16 barrel (20 inches or 508 mm), and the active plating length of anode 220 around 15% of the length of an M16 barrel. Indeed, the active plating length of anode 220 can be made even shorter. A shorter anode 220 advantageously reduces bubble production, which increases plating uniformity.

Now with reference to FIGS. 1-3, it should be noted that the rate at which plating material is deposited by anode assembly 112 onto the surface of the bore of gun barrel 102 can be determined experimentally for a predetermined current density provided by power supply 118 and relative to other established electro-processing parameters such as electrolyte solution composition and temperature, anode geometry, etc. Once a deposition rate is obtained, axial draw rate(s) for anode assembly 112 can be determined to ensure that desired thickness(es) of chrome plating is/are applied to bore 204 as anode 220 moves therethrough. In one implementation for plating an M16 barrel, an anode assembly 112 with electrode 220 having a plating length of 7.62 cm (3.0 in) and a diameter of 3.0 mm was operated to yield a current density of 19.3 A/dm$^2$ (the area of the adjacent M16 bore adjacent is 0.065 dm$^2$ (2.1 in$^2$)). Based on these parameters, it was determined that an effective draw rate was around 3 inches per hour, resulting in a total plating time of around 7 hours. These values are only exemplary however and can be expected to change depending on the particular implementation.

It should also be noted that the land and/or groove diameter(s) of bore 204 can be measured prior to plating using an air gage. (An air gage is an instrument that uses streams of air to accurately measure bore diameter.) Depending on the measured diameter, a desired amount of plating to apply can be determined (e.g., the difference between a target diameter and a measured diameter). A draw rate of anode assembly 112 can then be calculated based on the plating deposition rate of anode assembly 112 and the amount of plating that needs to be applied to yield the target diameter. Indeed, a series of diameter measurements can be taken at a plurality of locations (or even continuously) along the length of bore 102. Accordingly, in some embodiments, process controller 120 can control actuator 116 to vary the rate at which anode assembly 112 is pulled through barrel 102 depending on the axial position of anode assembly 112 within bore 204. This enables plating to be applied at different thicknesses along the length of bore 204. Furthermore, given a starting position of anode assembly 112 relative to barrel 102 and a length of bore 204, process controller 120 can also determine the axial position of anode assembly 112 during processing based on the implemented draw rate(s) and associated time(s) spent at those draw rate(s). Process controller 120 can thus know when to adjust the draw rate, stop processing, etc.

Figure 4A:
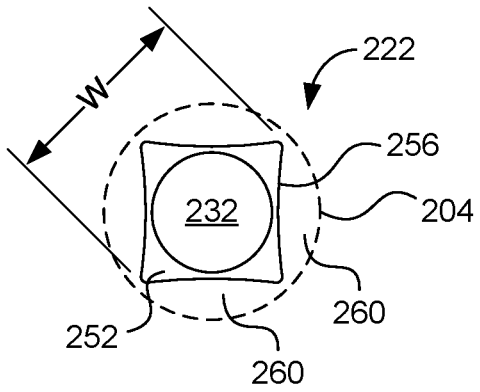
FIG. 4A is a top view of the bore guide of FIG. 2.
Figure 4B:
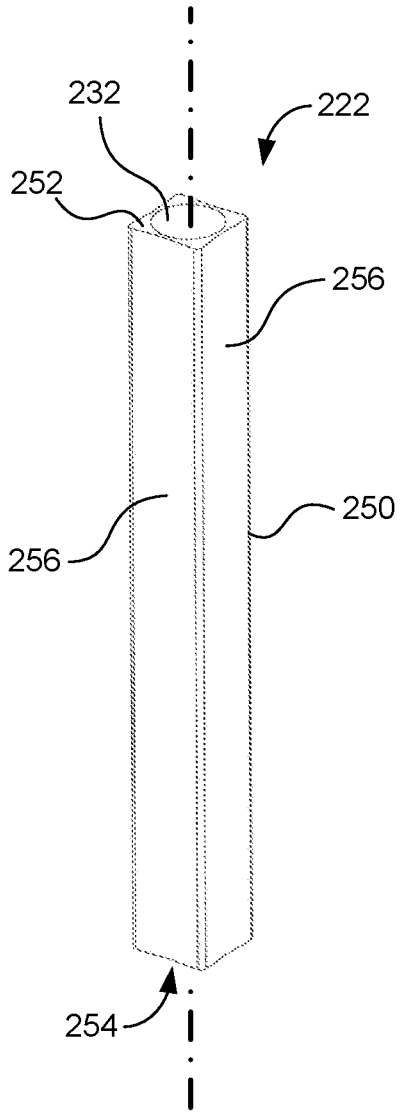
FIG. 4B is a perspective view of the bore guide of FIG. 2.

FIGS. 4A and 4B show top and perspective views of bore guide 222, respectively. Bore guide 222 includes an elongated, non-conductive body 250 having a top surface 252, a bottom surface 254, and a plurality of sidewalls 256 (four in this embodiment) between top and bottom surfaces 252 and 254. Passage 232 is formed axially through elongated body 250 from an opening 256 defined by top surface 252 to an opening 258 (FIG. 3) defined by bottom surface 254. Passage 232 is sized to closely accept electrode 220 therein through at least one of openings 256 and 258. A remainder of passage 232, and at least one of openings 256 and 258, are sized to pass lead 114 therethrough. Bore guide 222 can be formed from a non-conductive resin (e.g., ABS-M30, polyvinyl chloride (PVC), etc.) by 3-D printing, molding, milling, etc.

A beneficial aspect of bore guide 222 is that at least some of its sidewalls 256 are shaped to facilitate the passage of bubbles upward past bore guide 222. Here, each of sidewalls 256 is concave, and their inward arcuate shapes define a plurality of gaps 260 between bore guide 222 and bore 204 (shown representationally in dash) that permit bubbles passed. Meanwhile, a maximum width (W) of bore guide 222 in this embodiment is across a diagonal of top surface 252 and is slightly smaller (e.g., 0.0005-0.001 inches) than a land diameter of bore 204.

Accordingly, bore guide 222 also keeps anode assembly 112 well-centered in bore 204 and prevents electrode 220 from significant tipping toward or away from bore 204. Because bore guide 222 readily passes bubbles upward past anode assembly 112 and maintains electrode 220 in a centered position, the uniformity of the deposited chrome layer is improved, particularly in the rifling 210, and projectile accuracy is improved.

Figure 5A:
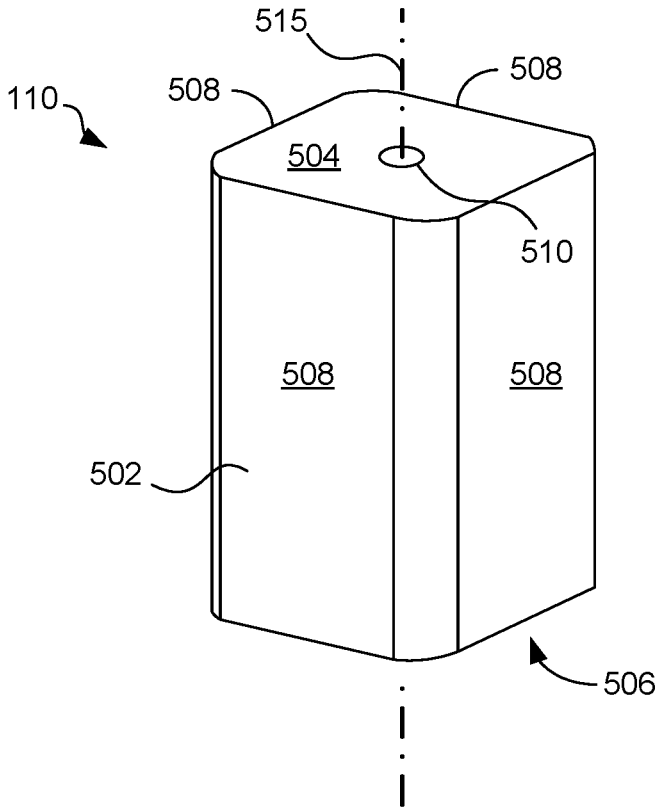
FIG. 5A is a perspective view showing the barrel end adapter of FIG. 1 in greater detail.

FIG. 5A is a perspective view showing barrel end adapter 110 in greater detail. Barrel end adapter 110 includes a non-conductive, generally-prismatic body 502 having a top surface 504, a bottom surface 506, and a plurality (e.g., four) of sidewalls 508 therebetween. Body 502 further includes a conduit 510 and barrel interface 512 (FIG. 5B) formed therein, which define an axis 515 through body 502. In this embodiment, barrel end adapter 110 is formed from a non-conductive material, such as PVC, by 3-D printing, molding, milling, tapping, or some combination thereof. In a particular embodiment for an M16 rifle, barrel end adapter 110 has exterior dimensions of around 2×2×6 inches, and conduit 510 has a diameter of 0.224 to 0.225 inches.

Figure 5B:
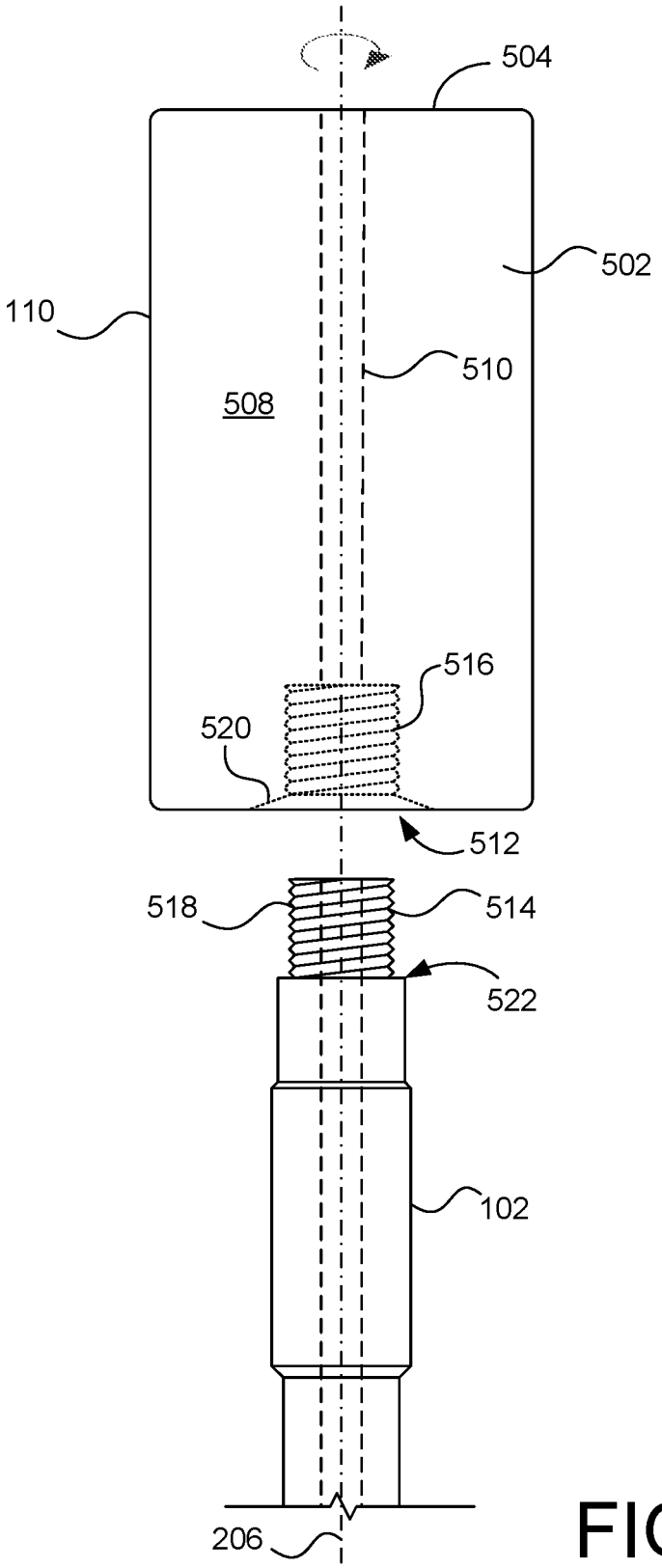
FIG. 5B is a plan view showing the barrel end adapter and barrel of FIG. 1 in greater detail.

FIG. 5B is a front plan view showing barrel end adapter 110 and barrel 102 in greater detail. In particular, barrel interface 512 is generally cylindrical and formed through bottom surface 506 of body 502. Barrel interface 512 is configured to removably engage a muzzle end 514 of gun barrel 102 such that barrel end adapter 110 can be temporarily affixed to barrel 102 with conduit 510 in axial alignment with bore 204. In this embodiment, barrel interface 512 comprises a thread set 516 for screwing onto a complementary thread set 518 formed on muzzle end 514 of barrel 102. After plating and removal of barrel end adapter 110, complementary thread set 518 can be used to mount a flash suppressor or other accessory (not shown) to barrel 102. In this embodiment, barrel interface 512 includes an optional countersunk seat 520 that engages a ledge 522 of barrel 102 below thread set 518.

Figure 5C:
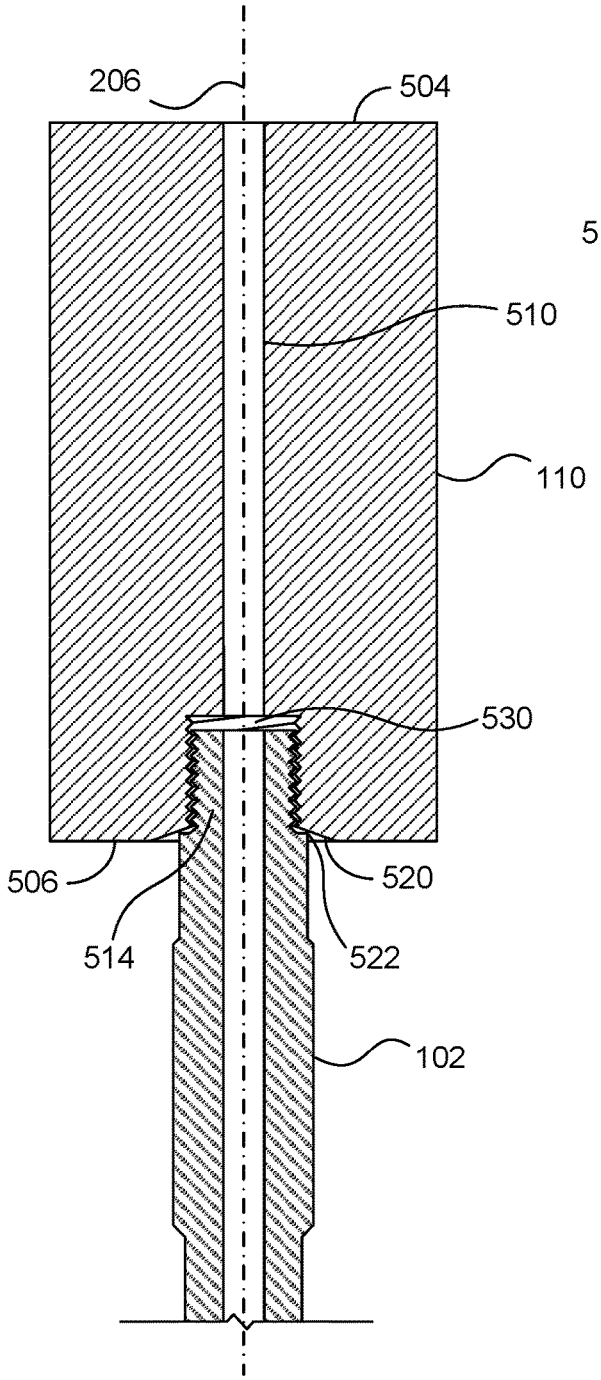
FIG. 5C is a cross-sectional view taken along line B-B of FIG. 1.

FIG. 5C is a cross-sectional view taken along line B-B of FIG. 1 showing barrel end adapter 110 screwed onto muzzle end 514 of barrel 102, but with lead 114 and anode assembly 112 removed. Conduit 510 is axially aligned with bore 204 on axis 206. Note that thread set 516 is slightly deeper than thread set 518, which leaves a small gap 530 between the ends of bore 204 and conduit 510 due to seat 520 contacting ledge 522. In other embodiments, thread sets 516 and 518 are configured such that no gap 530 exists.

Figure 5D:
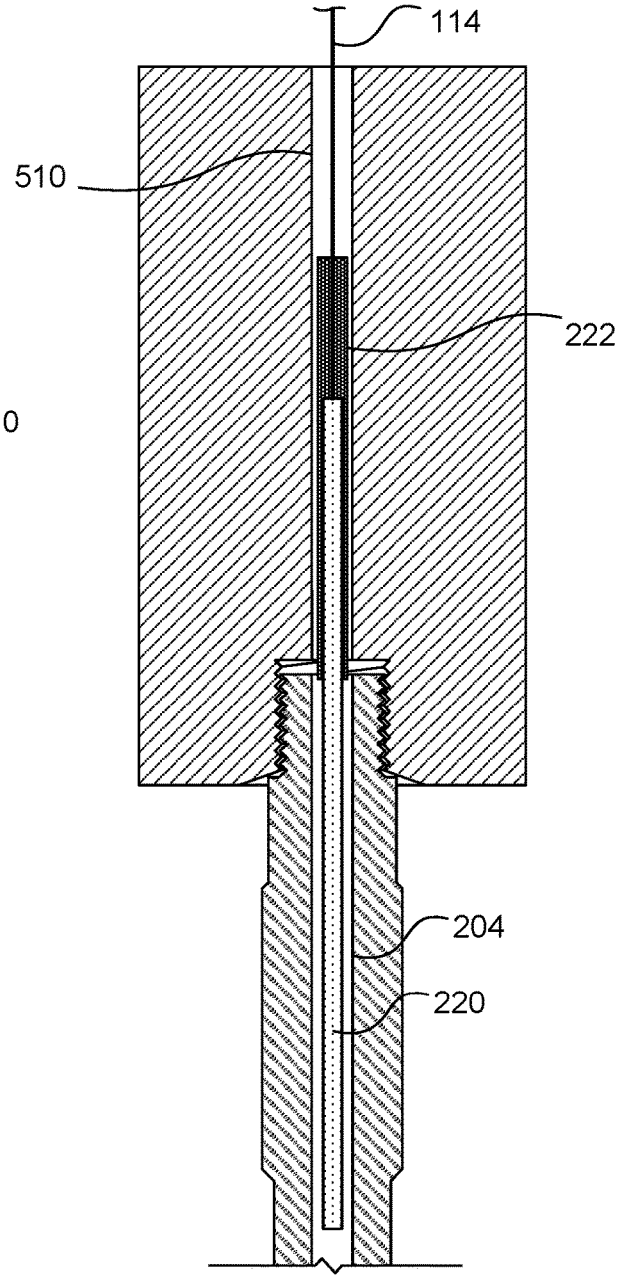
FIG. 5D is another cross-sectional view taken along line B-B of FIG. 1.

FIG. 5D is another cross-sectional view taken along line B-B that illustrates how barrel end adapter 110 guides anode assembly 112 as it is being drawn through the muzzle end 514 of barrel 510. In particular, as anode assembly 112 is drawn out bore 204 at muzzle end 514, the leading end of bore guide 222 enters conduit 510 of adapter 110. Conduit 510 thereafter functions to maintain electrode 220 in axial alignment with bore 204 as electrode 220 is drawn the remainder of the way through bore 204 and electroplating is completed on barrel 102. Because conduit 510 is sized to closely accept bore guide 222 therein, electrode 220 does not tilt as it is being pulled through the muzzle end 514 barrel 102, which maintains the uniformity of the plating near muzzle end 514.

Figure 6A:
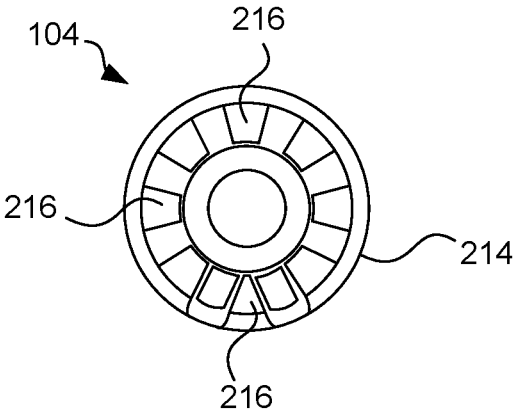
FIG. 6A is a bottom view of the barrel extension of FIG. 1.
Figure 6B:
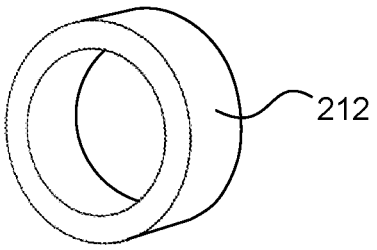
FIG. 6B is a perspective view of the extension shield of FIG. 2.

FIG. 6A is a bottom view of barrel extension 104 showing sidewall 214 and ribs 216 in greater detail. FIG. 6B is a perspective view of extension shield 212, which in this embodiment comprises a cylindrical tubular element made of a flexible insulating material (e.g., rubber, etc.). The flexibility enables extension shield 212 to be temporarily deformed to facilitate insertion past ribs 216 and into position against the inner surface of sidewall 214 of barrel extension 104. In a particular embodiment, barrel shield 212 is made of rubber, has a 0.810 inch outer diameter, a 0.620 inch inner diameter, and is 0.285 inches tall. Other shapes and sizes of extension shields can be provided depending on the shapes of the surfaces to be covered.

As will be apparent from the foregoing description, the present disclosure describes a bore guide system for use in electro-processing (e.g., chrome plating, etc.) a gun barrel, which includes an external bore guide (e.g., barrel end adapter 110) and an internal bore guide (e.g., bore guide 222), both of which are non-conductive. The external bore guide is configured to removably engage the outside of the gun barrel and includes a conduit formed therein, which axially aligns with the bore of the barrel when the external bore guide is engaged therewith. In contrast, the internal bore guide is sized to facilitate movement of the internal bore guide within the bore of the barrel and within the conduit of the external bore guide. The internal bore guide includes an axial recess formed therein that is configured to seat an electro-processing electrode (e.g., an anode). Optionally, the bore guide system can also include one or more processing shield(s) (e.g., extension shield 212) to prevent portions of the barrel from being electro-processed.

While particular embodiments have been described above, it should be recognized that alterations and modifications can be made without departing from the spirit and scope of the invention. For example, a bore guide having a triangular cross-section, with or without concave sidewalls, can be used. Additionally, the dimensions and parameters provided above are only exemplary and can be altered as desired. Electrode 220 can also take other forms and can be affixed to bore guide in other ways (e.g., by a snap-in channel, etc.). Barrel end adapter 110 can also be modified, for example, such that it can be temporarily affixed to the outside of a barrel by interference fit, clamping, etc. Such an alternative is useful where the barrel does not have a threaded muzzle end. Like bore guide, the shape and dimensions of barrel end adapter 110 can also be modified as desired. These and other modifications will become apparent in view of the present disclosure.

Figure 7:
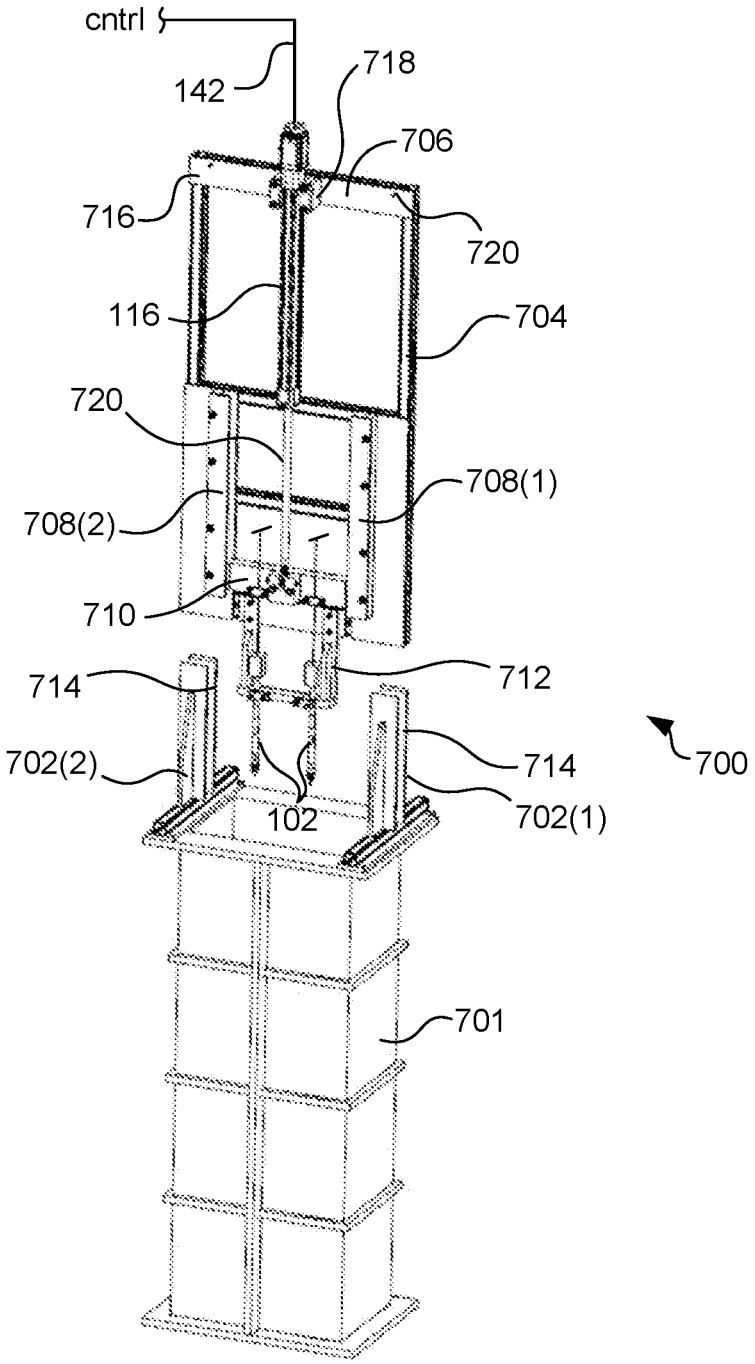
FIG. 7 is a perspective view showing a support structure according to an exemplary embodiment of the invention mounted to an electro-processing tank.

FIG. 7 is a perspective view showing an exemplary embodiment of a support structure (fixture) 700 for supporting a plurality of gun barrels 102 to be electro-processed according to the present invention within a tank 701 of chroming solution (e.g., a solution of chromic and sulfuric acids, etc.). The electrolyte is omitted from FIG. 7 and subsequent figures so as not to unnecessarily obscure other elements.

Support structure 700 includes a plurality of risers 702 (1-2), a frame 704, an actuator mount 706, a plurality of guides 708(1-2), a lead puller 710, and a barrel mount 712. The elements of support structure 700 cooperate to hold a plurality of barrels 102 vertically within tank 701 and facilitate movement of anode assemblies 112 therethrough. In particular, each of risers 702(1-2) is affixed (e.g., by clamps, fasteners, etc.) to the upper perimeter of tank 701 and includes a receiver 714 that removably receives an associated portion of frame 704 therein. Frame 704 is generally rectangular and provides a structure on which to mount actuator 116, guides 708(1-2), carrier 710, and barrel mount 712. When the lateral sides of frame 704 are positioned in receivers 714, frame 704 stands vertically over the open top of tank 701.

Actuator mount 706 includes a support plate 716 affixed to frame 704 and a bracket 718 affixed to support plate 716. Support plate 716 is shown affixed to frame by fasteners 720 but alternatively could be welded, etc. Bracket 718 can be similarly affixed to support plate 716 by fasteners, welding, etc. Actuator 116 is a linear actuator in this example (e.g., a Nook™ In-Line ACME Screw Drive Programmable Actuator, etc.), so bracket 718 mounts (e.g., clamps, etc.) actuator 116 in a vertical orientation with its shaft 720 directed vertically toward lead puller 710. Support plate 716 is affixed near the top of frame 704 to accommodate the stroke of shaft 720 but can be readily repositioned to accommodate other actuator mechanisms (e.g., a rotational actuator, pulleys, gears, racks, etc.).

Guides 708(1-2) comprise guide rails coupled longitudinally to frame on either side of shaft 720. Lead puller 710 is mounted transversely so as to slide vertically within guide rails 708(1-2). The distal end of actuator shaft 720 is affixed to lead puller 710 such that lead puller 710 moves up and down as shaft 720 retracts and extends, respectively. Lead puller 710 also includes a plurality of attachment mechanisms (FIG. 8), which selectively affix leads 114 to puller 710. Barrel mount 712 removably affixes a plurality of barrels 102 and positions them in tank 701 for electro-processing. Thus, when shaft 720 extends, lead puller 710 moves the leads 114 and associated anode assemblies 112 coupled thereto downward (e.g., further into barrels 102). When shaft 720 retracts, lead puller 710 moves upward, thereby pulling leads 114 and the anode assemblies 112 attached thereto upward toward the muzzle ends of barrels 102.

Figure 8:
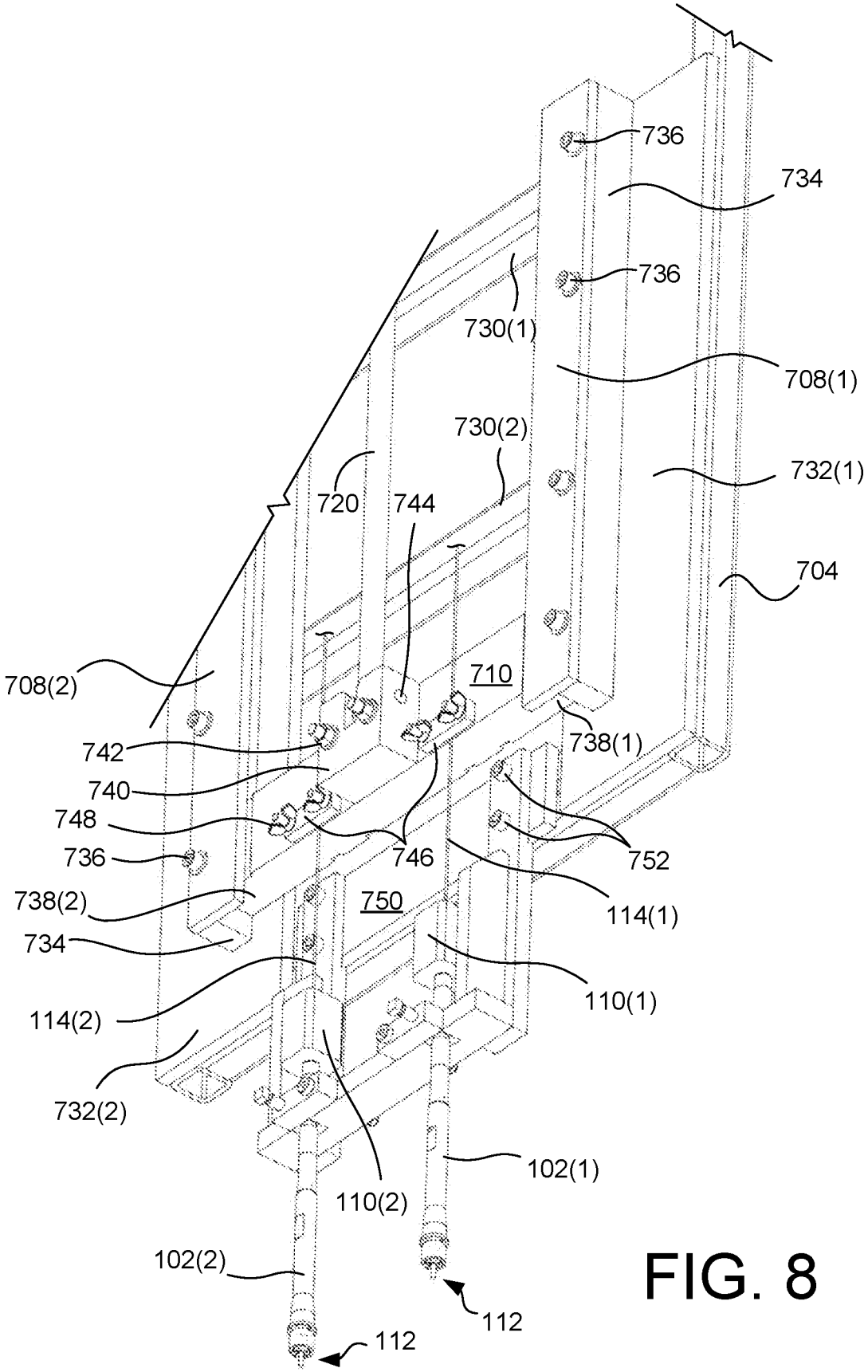
FIG. 8 is a front perspective view showing a portion of the support structure of FIG. 7 in greater detail.

FIG. 8 is a front perspective view showing a portion of support structure 700 in greater detail. FIG. 8 shows that frame 704 is fabricated from square tubing that is, for example, welded together at the corners where the tube sections abut. Frame 704 is also shown to include a plurality of intermediate cross-members 730(1-2) that extend between the lateral sides of frame 704 to support other elements. Guide rail supports 732(1-2) comprise rectangular plates mounted (e.g., welded) to the front of frame 704. Each of guide rails 708(1-2) is mounted on a respective one of guide rail supports 732(1-2) via a riser 734 and a plurality of fasteners 736. Fasteners 736 pass through apertures formed in guide rails 708(1-2) and risers 734 to secure guide rails 708(1-2) to supports 732(1-2). Thus assembled, guide rails 708(1-2) and risers 734 define opposing gibs, where risers 734 define gaps between supports 732(1-2) and guide rails 708(1-2) in which the lateral ends 738(1-2) of lead puller 710 ride. The lateral ends 738(1-2) are also notched to maintain lead puller 710 generally-orthogonal to guide rails 708(1-2) during vertical travel. In the present example, the vertical lengths of guide rails 708(1-2) and supports 732(1-2) are selected based on the travel of shaft 720 of actuator 116.

Puller 710 is also shown in greater detail to includes a shaft bracket 740 affixed thereto by threaded fasteners 742 (e.g., bolts and nuts, etc.). Shaft 720 is coupled to shaft bracket 740 via a pin 744 passing through bracket 740 and shaft 720. Accordingly, movement of actuator shaft 720 causes corresponding movement of puller 710. Puller 710 also includes a plurality of lead couplers 746, which are secured to puller 710 via threaded fasteners 748 in this example. Fasteners 748 comprise wing nuts for rapid removal and reinstallation. When leads 114(1-2) are clamped between lead couplers 746(1-2) and puller 710, respectively, vertical movement of shaft 720 causes corresponding vertical movement of leads 114(1-2) and their attached anode assemblies 112(1-2).

FIG. 8 also shows that barrel mount 712 is affixed to a bottom plate 750 of frame 704 via pairs of threaded fasteners 752. Plate 750 itself can be affixed to frame 704 by welding, fasteners, etc. Barrel mount 712 holds a plurality of barrels 102(1-2) vertically such that leads 114(1-2) are axially aligned with their respective bores 204. Lead couplers 746 permit lateral adjustment of leads 114(1-2) relative to the bores 204 of each barrel 102(1-2). When installed, leads 114(1-2) pass between respective lead couplers 746(1-2) and puller 710, through respective barrel end adapters 110, through respective bores 204 of barrels 102(1-2) to electrically couple with respective anode assemblies 112(1-2). From this position, upward movement of puller 710 caused by actuator 116 retracting shaft 720 pulls anode assemblies 112(1-2) vertically through barrels 102. Leads 114(1-2) are truncated in FIG. 8 so as not to obscure other elements. However, it should be understood that leads 114(1-2) will be coupled to receive electric power from one or more power source(s) (e.g., power supply(ies) 118) during electro-processing.

Figure 9:
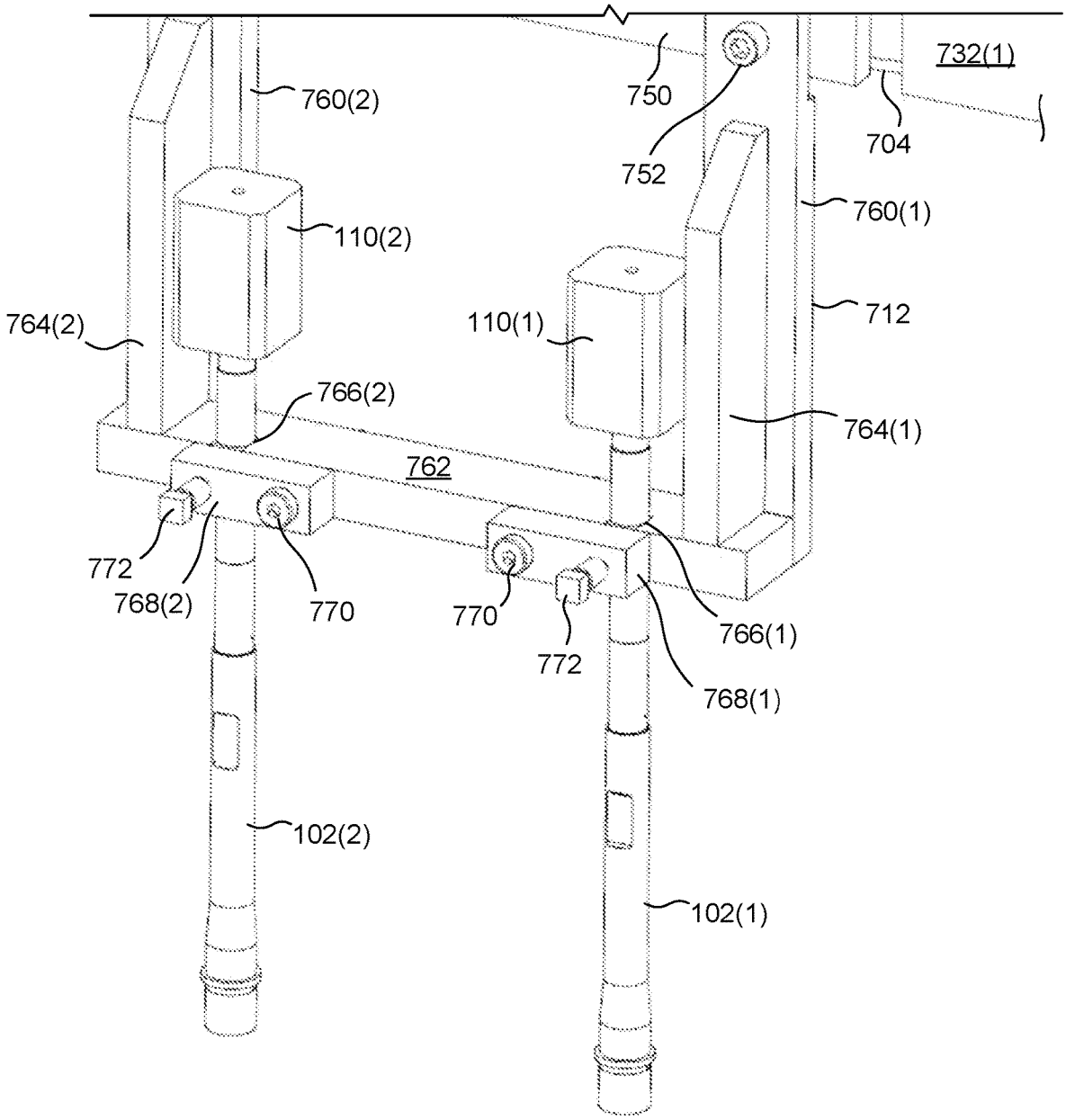
FIG. 9 is a front perspective view showing another portion of the support structure of FIG. 7 in greater detail.

FIG. 9 is a front perspective view showing barrel mount 712 in larger detail. Barrel mount 712 includes a plurality of drop arms 760(1-2), which are affixed to bottom plate 750 of frame 704 via fasteners 752. Drop arms 760(1-2) extend below the bottom of frame 704 and enable barrels 102(1-2) and barrel end adapters 110(1-2) to be submerged in electrolyte in tank 701. Barrel mount 712 also includes a cross member 762, which is affixed to drop arms 760(1-2). Buttresses 764(1-2) further connect cross member 762 and drop arms 760(1-2). Cross member 762 defines a plurality of notches 766(1-2), which receive respective barrels 102(1-2) therein. Each notch 766(1-2) is selectively closed by a clamp 768(1-2), which can be rotated into or out of position over notches 766(1-2) by loosening fasteners 770(1-2), respectively. When clamps 768(1-2) are securely positioned over notches 766(1-2), the barrels 102(1-2) are further secured within notches 722(1-2) by tightening set bolts 772(1-2) against the outside of barrels 102(1-2), respectively. This prevents the barrels 102(1-2) from moving (e.g., due to electrolyte agitation, etc.) during electroplating.

In FIG. 9, barrels 102(1-2) have been prepared for electro-processing by undergoing prior cleaning and have barrel end adapters 110(1-2) and extension shields (not shown) installed. Anode assemblies 112(1-2) and leads 114(1-2) can now be installed through the conduits 510 of barrel end adapters 110(1-2) and through bores 204 of barrels 102(1-2), respectively, until the electrodes 220 of anode assemblies 112(1-2) are in their desired start positions for electroplating. Once leads 114(1-2) are secured to puller 710, leads 114(1-2) and anode assemblies 112(1-2) can be electrified and pulled through barrels 102(1-2) at a desired rate(s) of travel to apply plating at one or more desired thickness(es) to bores 204.

Figure 10:
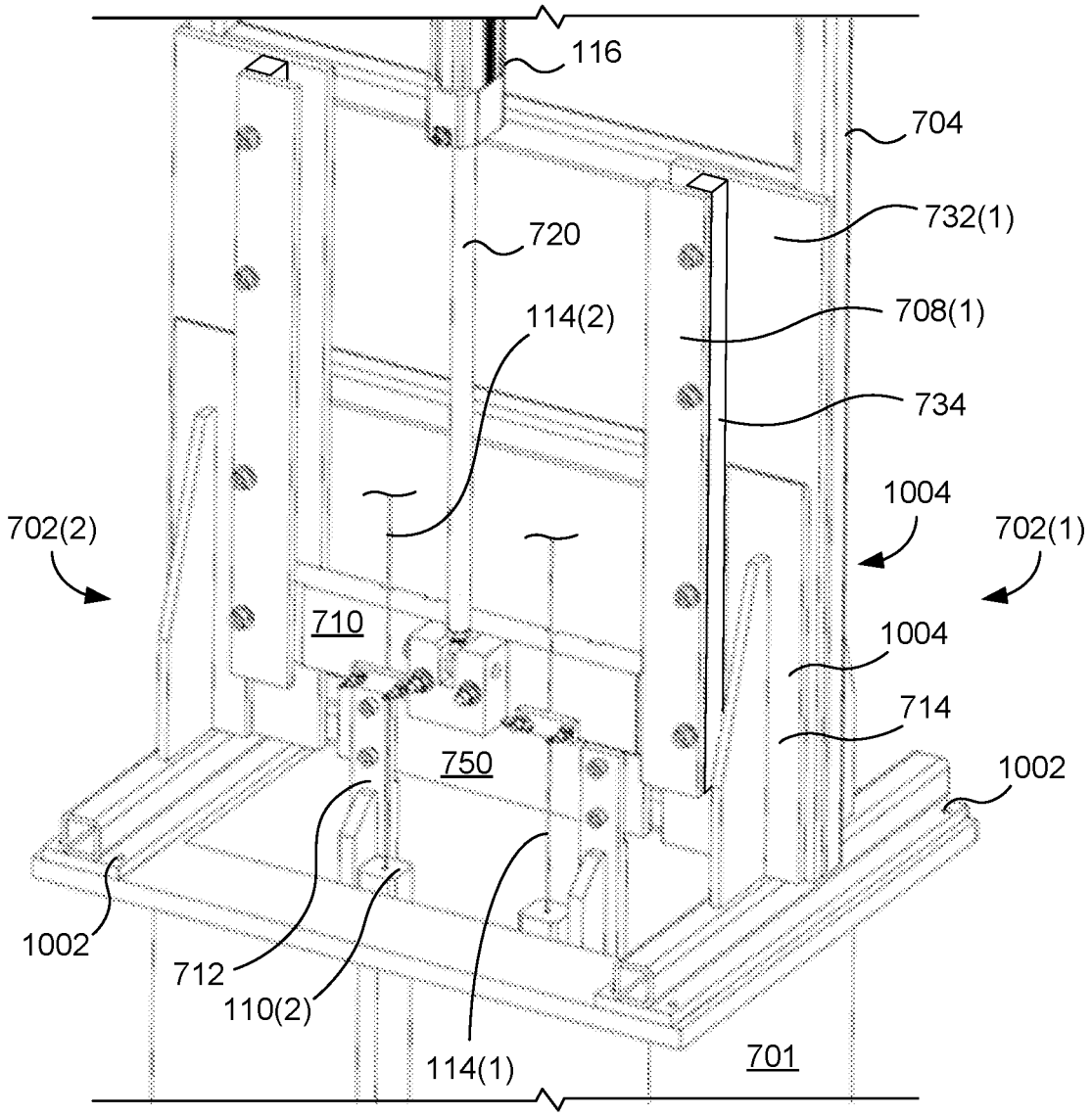
FIG. 10 is a front perspective view showing a portion of the support structure of FIG. 7 at the beginning of electro-processing.

FIG. 10 is a front perspective view showing support structure 700 at the beginning of an electroplating process. Here two barrels 102(1-2) are secured to barrel mount 712 and are submerged in electrolyte (not shown) in tank 701. Shaft 720 of actuator 116 is extended to position puller 710 at or near the bottom of its range of travel. Anode assemblies 112(1-2) (not shown) and leads 114(1-2) are positioned axially through barrel adapters 110(1-2) and barrels 102(1-2), respectively, and are secured within lead coupler 746(1-2) so that puller 710 can draw anode assemblies 112(1-2) vertically when actuator 116 retracts shaft 720. FIG. 10 also shows that risers 702(1-2) are fabricated from tubular and plate metal components and are secured to the top of tank 701 via fasteners 1002. Here, front and rear complementary vertical members 1004 (e.g., plates, etc.) define a receiver 714 with a gap 1006 that receives frame 704 vertically therein.

Figure 11:
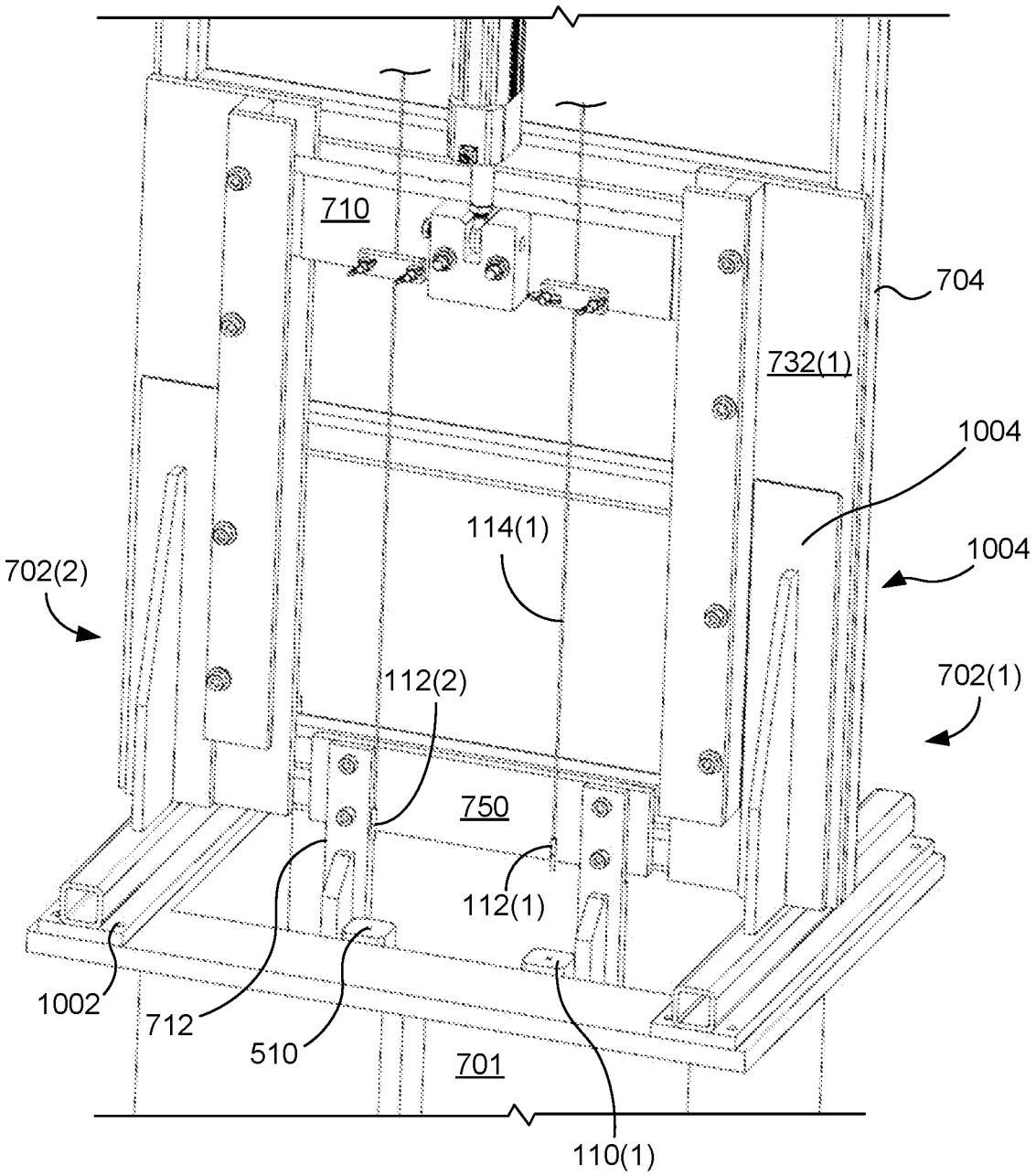
FIG. 11 is a front perspective view showing a portion of the support structure of FIG. 7 after electro-processing.

FIG. 11 is a front perspective view showing frame 704 similar to FIG. 10 after the electroplating process of the bores 204 of barrels 102(1-2) has been completed. As shown, actuator 116 has moved puller 710 to near the top of its stroke, thereby drawing anode assemblies 112 through bores 204 of barrels 102(1-2) and through conduits 510 of barrel end adapters 110(1-2). Accordingly, the powered anode assemblies 112 will have uniformly plated bores 204 of barrels 102(1-2) as they were drawn through bores 204. Barrels 102(1-2) can now be removed from barrel mount 712 and rinsed.

While FIGS. 7-11 describe a particular embodiment of a support structure 700 for use with electro-processing system 100, it should be understood that other support structures can be employed. For example, support structure 700 can be modified to provide an actuator for each barrel 102, such that the actuators can be operated to provide different draw rates.

Figure 12:
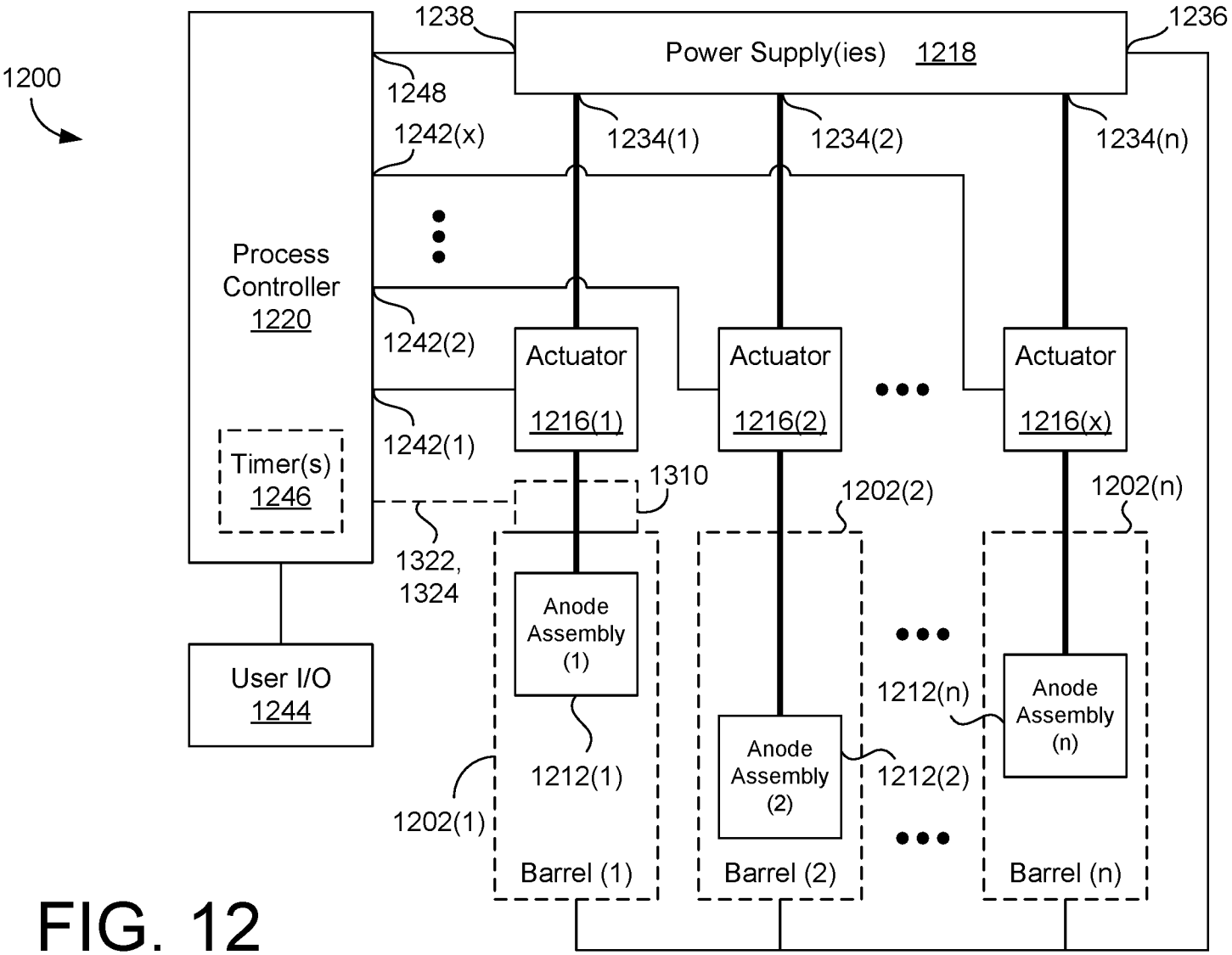
FIG. 12 is a block diagram of a system for electro-processing a plurality of small-bore gun barrels according to another embodiment of the invention.

FIG. 12 is a block diagram illustrating another system 1200 for electroplating a plurality of small-bore gun barrels **1202(1-*n*) according to another embodiment of the invention. System 1200 includes a plurality of anode assemblies 1212(1-*n*) electrically coupled to respective ones of a plurality of conductive leads 1214(1-*n*), a plurality of actuators 1216(1-*x*), one or more power supplies 1218 (one in this example), a process controller 1220, and a user input/output (I/O) 1244. Anode assemblies 1212(1**-*n*) and leads 1214(1-*n*) can be similar to those anode assemblies and leads described above or different. Similarly, actuators 1216(1-*x*) can be linear actuators as described above, rotational actuators, rack-and-gear drive actuators, etc. or some combination thereof. In the embodiment shown, there is one actuator 1216 per anode assembly 1212 such that (x) equals (n). However, in other embodiments the number of actuators 1216 can be different (e.g., less than) the number of anode assemblies 1212, for example, where one actuator 1216 moves multiple anode assemblies 1212.

Support structure(s) holding barrels 1202(1-*n*) in a tank of electrolyte is/are omitted from FIG. 12. However, such support structure(s) can be implemented employing design considerations and features discussed above. The design of such support structures will also take into consideration the type(s) of actuator(s) 116 employed, the size and shape of the electrolyte tank, the space around such tank, etc.

Power supply 1218 includes a plurality of first (e.g., positive) power supply terminals 1234(1-*n*), a common (e.g., negative) power supply terminal 1236, and a control input set 1238. Each of first power supply terminals 1234(1-*n*) is electrically coupled to a respective one of leads 1214(1-*n*) and is operative to supply process current to a respective one of anode assemblies 1212(1-*n*). Common power supply terminal 1236 is electrically coupled to each of barrels 1212(1-*n*), for example, via the support structure(s) holding barrels 1202(1-*n*) in the electrolyte. Alternatively, a power supply terminal 1236 can be provided for each barrel 1202(1-*n*). Power supply 1218 is also coupled to receive control signals from process controller 1220 (or directly from a user) via a control input set 1238. Responsive to the control signals received, power supply 1218 is operative to assert process current to carry out electroplating of barrels 1202(1-*n*).

Process controller 1220 includes a plurality of actuator control sets 1242(1-*x*), one or more power supply control set(s) 1248 (one in the present example), one or more user input/output(s) 1244, and one or more timers 1246. Process controller 1220 can be implemented in hardware (e.g., in an integrated circuit, firmware, etc.), in software (e.g., stored or running in memory of a computer), etc. or some combination thereof. Process controller 1220 is operative to assert control signals on each of actuators 1216(1-*x*) via respective actuator control sets 1242(1-*x*) to control the rate at which each of actuators 1216(1-*x*) moves each of anode assemblies 1212(1-*n*). Accordingly, process controller 1220 enables each of anode assemblies 1212(1-*n*) to be moved independently (in the case that x equals n) or in predetermined groups (where x is less than n). Timer 1246 provides time information/signal(s) and enables process controller 1220 to adjust the rate of travel of each of anode assemblies 1212 (1-*n*) during the electroplating process to yield a desired plating thickness. Additionally, given known barrel length(s) and the initial positions of anode assemblies 1212(1-*n*) relative to barrels 1202(1-*n*), respectively, process controller 1220 can determine the position of each anode assembly 1212 throughout the plating process depending on their respective anode draw rate(s) and the time period(s) at those draw rates. Process controller 1220 can also controls power supply 1218 via control set 1248 to selectively power ones of power supply terminals 1234(1-*n*) and common power supply terminal 1236.

System 1200 has the advantage that the electroplating process can be controlled for each barrel 1202(1-*n*) (or groups of barrels where x is less than n) independently. For example, process controller 1220 can slow the movement of an anode assembly 1212 through a barrel 1202 whose bore needs thicker plating. Conversely, process controller 1220 can increase the rate of travel of an anode assembly 1212 through a barrel 1202 whose bore needs thinner plating. Moreover, process controller 1220 can vary the rate of travel of each individual anode assembly 1212 through the bore of its associated barrel 1202 to apply different plating thicknesses to different regions of the bore. Thicker plating can thus be applied in desirable regions of the bore (e.g., near the muzzle end, in the throat, etc.) of a barrel 1202 by process controller 1220 slowing the draw rate of the anode assembly 1202 in those regions. Similarly, the draw rates implemented for a barrel 1202 can be varied to "even-out" variations in a diameter of the bore along the length of the barrel. Bore diameter(s) can be determined for each barrel, for example, by air-gaging as discussed above.

Figure 13:
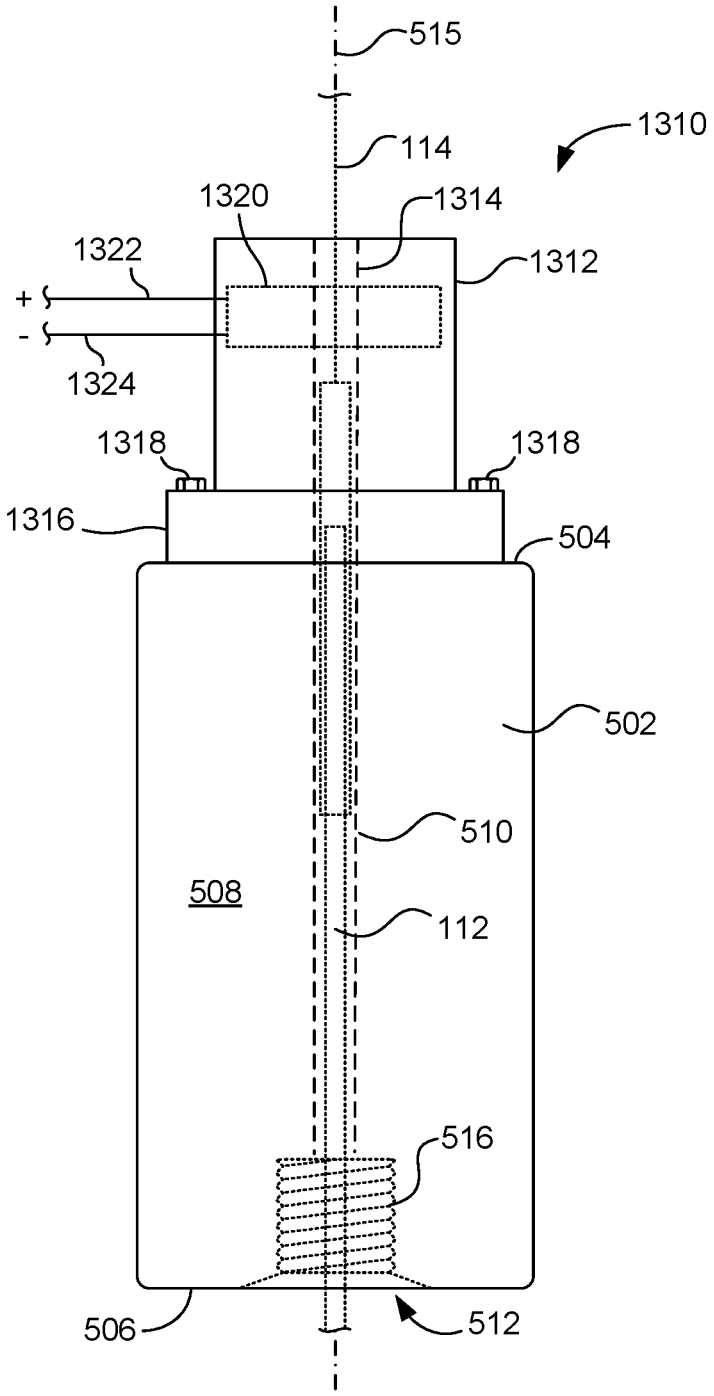
FIG. 13 is a front plan view showing a barrel end adapter according an another exemplary embodiment of the present invention.

FIG. 13 is a front plan view showing a barrel end adapter 1310 according another exemplary embodiment of the present invention. Like barrel end adapter 510, barrel end adapter 1310 includes a non-conductive, generally-prismatic body 502 having a top surface 504, a bottom surface 506, and a plurality (e.g., four) of sidewalls 508 therebetween. Body 502 further includes a conduit 510 and barrel interface 512 formed therein along an axis 515. Like barrel end adapter 110, body 502 of barrel end adapter 1310 is formed from a non-conductive material, such as PVC, by 3-D printing, molding, milling, tapping, or some combination thereof.

Unlike adapter 510, however, barrel end adapter 1310 further comprises a detector device 1312 having a conduit 1314 formed therethrough and a flange 1316. Detector device 1312 is coupled to top surface 504 of body 502 via a plurality of fasteners 1318 (e.g., two, four, etc.) passed through flange 1316 and into top surface 504. In this embodiment, detector device 1312 includes a wire coil 1320 wound about axis 515 and having a plurality of control leads 1322 and 1324 configured to electrically couple coil 1320 with a process controller (e.g., process controller 120, process controller 1220, etc.; see e.g., FIG. 12).

Detector device 1312 enables the process controller to detect the passage of an anode assembly (e.g., anode assembly 112, etc.) through detector device 1312 by providing a detection signal via first and second control leads 1322 and 1324. In particular, as a lead (e.g., lead 114, etc.) is pulled through conduit 1314 during electro-processing, lead 114 induces a voltage on the coil 1320, causing amperage feedback to the process controller. Based on such feedback, the process controller can determine when the anode assembly 112 has exited barrel end adapter 1310 and thus the barrel.

In this embodiment, detector device 1312 is ruggedized (e.g., sealed against liquid intrusion, etc.) to withstand the harsh environment of the chemical bath. Additionally, during electro-processing, the barrel end adapter 1310 can be submerged up to flange 1316 to prevent corrosion and/or inadvertent shorting of wire coil 1320.

Figure 14:
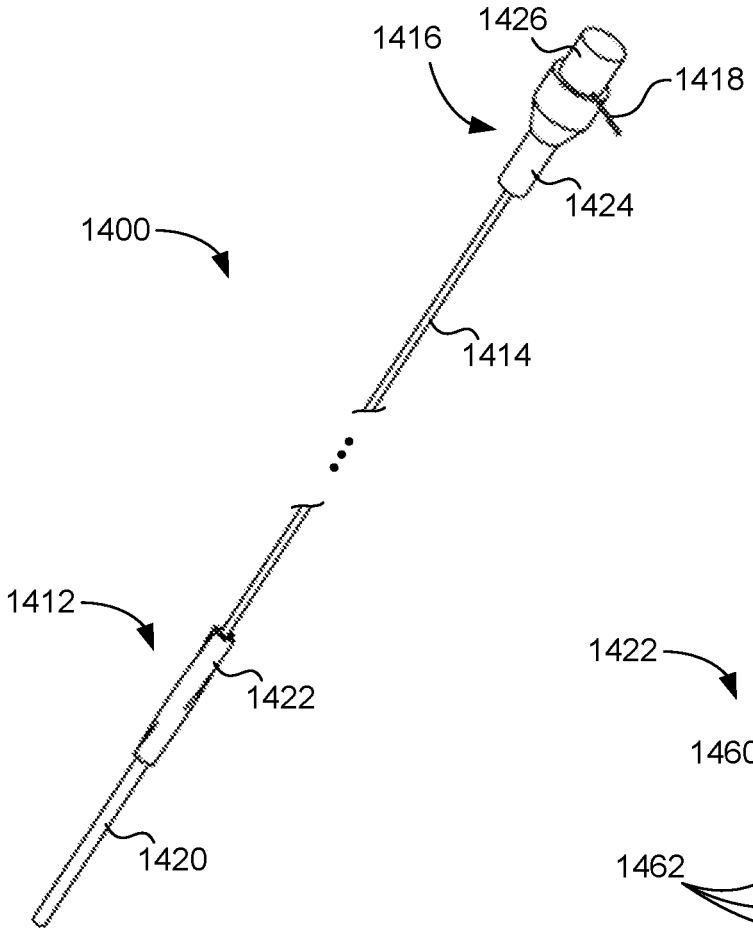
FIG. 14 is a perspective view showing a rotary electro-processing assembly according to another embodiment of the present invention.

FIG. 14 is a perspective view showing a rotary electro-processing assembly 1400 according to another embodiment of the present invention. Assembly 1400 includes a rotary electrode assembly 1412, a lead 1414, and a rotary coupling 1416 including a power terminal 1418. Electrode assembly 1412 includes a fluted bore guide 1422 coupled to an electrode 1420. As above, electrode 1420 will be referred to as an anode herein, but in other cases could function as a cathode.

Rotary electro-processing assembly 1400 facilitates rotation of anode assembly 1412 as anode assembly 1412 is drawn through the bore 204 of a gun barrel 102 during electro-processing (elecro-plating in this example). Rotary coupling 1416 includes a lower portion 1424 that rotates relative to an upper portion 1426 having power terminal 1418 electrically coupled thereto. Upper portion 1426 is configured to be mounted to a lead puller of an associated fixture (e.g., lead puller 710 of fixture 700, etc.) such that power terminal 1418 can be electrically coupled to a power supply (e.g., power supply 118, power supply 1218, etc.). Upper portion 1426 can be insulated to prevent shorting power terminal 1418 to the fixture. In a particular embodiment, rotary coupling 1416 comprises a Mercotac 110-T electrical slip ring.

Lead 1414 is similar to lead 114, except that lead 1414 is electrically coupled between lower portion 1424 of rotary coupling 1416 and anode 1420. Anode 1420 is substantially similar to anode 220 discussed previously. Here, however, anode 1420 is coupled to fluted bore guide 1422, which rotates as it is drawn through the rifled bore 204 of gun barrel 102 as will be discussed below.

Figure 15:
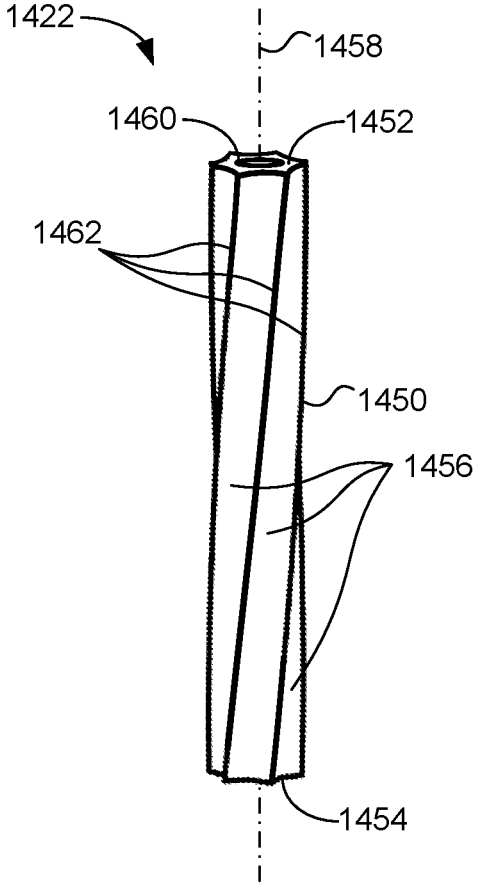
FIG. 15 is a perspective view showing the bore guide of FIG. 14 in greater detail.

FIG. 15 is a perspective view showing fluted bore guide 1422 in greater detail. Bore guide 1422 includes an elongated, non-conductive body 1450 having a top surface 1452, a bottom surface 1454, and a plurality of helical flutes 1456 formed therebetween about axis 1458. A passage 1460 is formed axially through top surface 1452, through elongated body 1450, and through bottom surface 1454. Passage 1460 is sized to closely accept anode 1420 therein through the opening in bottom surface 1454. In a particular embodiment, fluted bore guide 1422 is approximately 1.5" in length, and is configured to seat approximately one inch of anode 1420 therein. A remainder of passage 1460 and the opening in top surface 1452 are sized to pass lead 1414 therethrough. Bore guide 1422 can be formed from a non-conductive resin (e.g., ABS-M30, polyvinyl chloride (PVC), etc.) by 3-D printing, molding, milling, etc.

A beneficial aspect of bore guide 1422 is that the ridges 1462 between adjacent flutes 1456 are configured to engage the grooves of rifling 210 formed on bore 204 of barrel 102. This engagement causes bore guide 1422 to rotate about axis 1458 as it is pulled through bore 204, which in turn, causes anode 1420, lead 1414, and lower portion 1424 of rotary coupling 1416 to rotate as well. The rotating bore guide 1422, thus, advantageously acts as a pump to move gases and chrome solution away from anode 1420 via the helical flutes 1456. Additionally, the rotation of anode 1420 assists in evening out the application of chrome to bore 204, thereby creating a more consistent and evenly applied thickness of chrome.

As mentioned above, the form of flutes 1456 are complementary to the rifling 210 of bore 204. In a particular embodiment, the number of flute ridges 1462 is equal to the number of grooves in the rifling 210. Additionally, the inches per turn (along axis 1458) of flutes 1456 can be the same as rifling 210. In other embodiments, however, the number of flute ridges 1462 and/or inches-per-turn of the flutes of bore guide 1422 can be different from rifling 210. For example, rifling 210 can have a number of grooves that is an integer multiple of the number of ridges 1462 (e.g., six rifling grooves to 2 ridges 1462, etc.). As mentioned previously, inconsistent application of chrome to a rifled bore has historically been a detriment to the accuracy of rifle barrels. These features associated with bore guide 1422, and others of the invention described herein, improve the quality of the chrome plating, thereby producing a barrel that yields accuracy approaching that of an unlined barrel, but with superior resistance to projectile wear.

Exemplary methods of the present invention will now be described with reference to FIGS. 16 and 17. For the sake of clear explanation, these methods might be described with reference to particular elements or modules of the foregoing description. However, it should be noted that other elements or modules, whether explicitly described herein or created in view of the present disclosure, can be substituted for those referenced without departing from the scope of the present invention. Accordingly, the methods of the present invention are not limited to any particular element(s) that perform(s) any particular functions. Furthermore, the steps of the methods presented herein need not necessarily occur in the order shown and/or some steps might occur simultaneously. These and other variations of the disclosed methods will be readily apparent in view of this disclosure and are considered to be within the scope of the invention.

Figure 16:
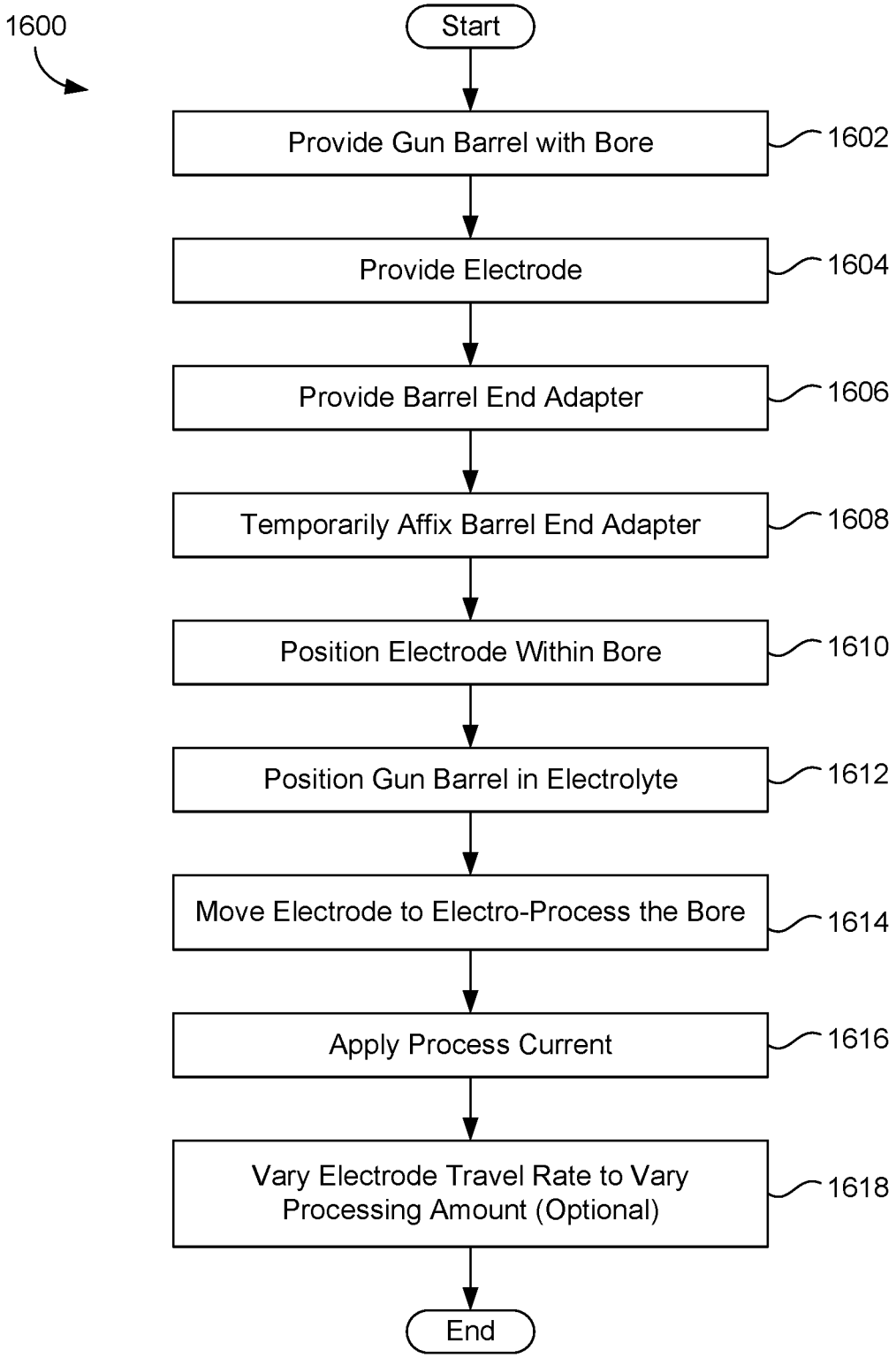
FIG. 16 is a flowchart summarizing an exemplary method for electro-processing a bore of a small-bore gun barrel.

FIG. 16 is a flowchart summarizing an exemplary method 1600 for electro-processing a bore of a gun barrel according to the present invention. In a first step 1602, a gun barrel having a bore defining an axis is provided. Prior to electro-processing, the bore of the barrel can be electro-cleaned (electro-polished), rinsed with clean water, and dried. In a second step 1604, an electrode having a lead electrically coupled thereto is provided, where the length of the electrode is less than the length of the bore. In a third step 1606, a barrel end adapter defining a conduit therethrough is provided, and in a fourth step 1608 the barrel end adapter is temporarily affixed to a first end of the gun barrel such that the conduit is axially aligned with the bore. In a fifth step 1610, the electrode is positioned within the bore of the gun barrel, and in a sixth step 1612, the gun barrel is positioned in an electro-processing solution (e.g., a chromium electrolyte, etc.). In a seventh step 1614, the electrode is moved within at least one of the bore of the gun barrel and the conduit of the barrel end adapter. In an eighth step 1616, process current is applied via the electrode during the step of moving the electrode to cause the bore to be electro-processed (e.g., electroplated). In an optional ninth step 1618, the rate of travel of the electrode through the bore can be varied to adjust the amount of electro-processing applied to the bore.

Figure 17:
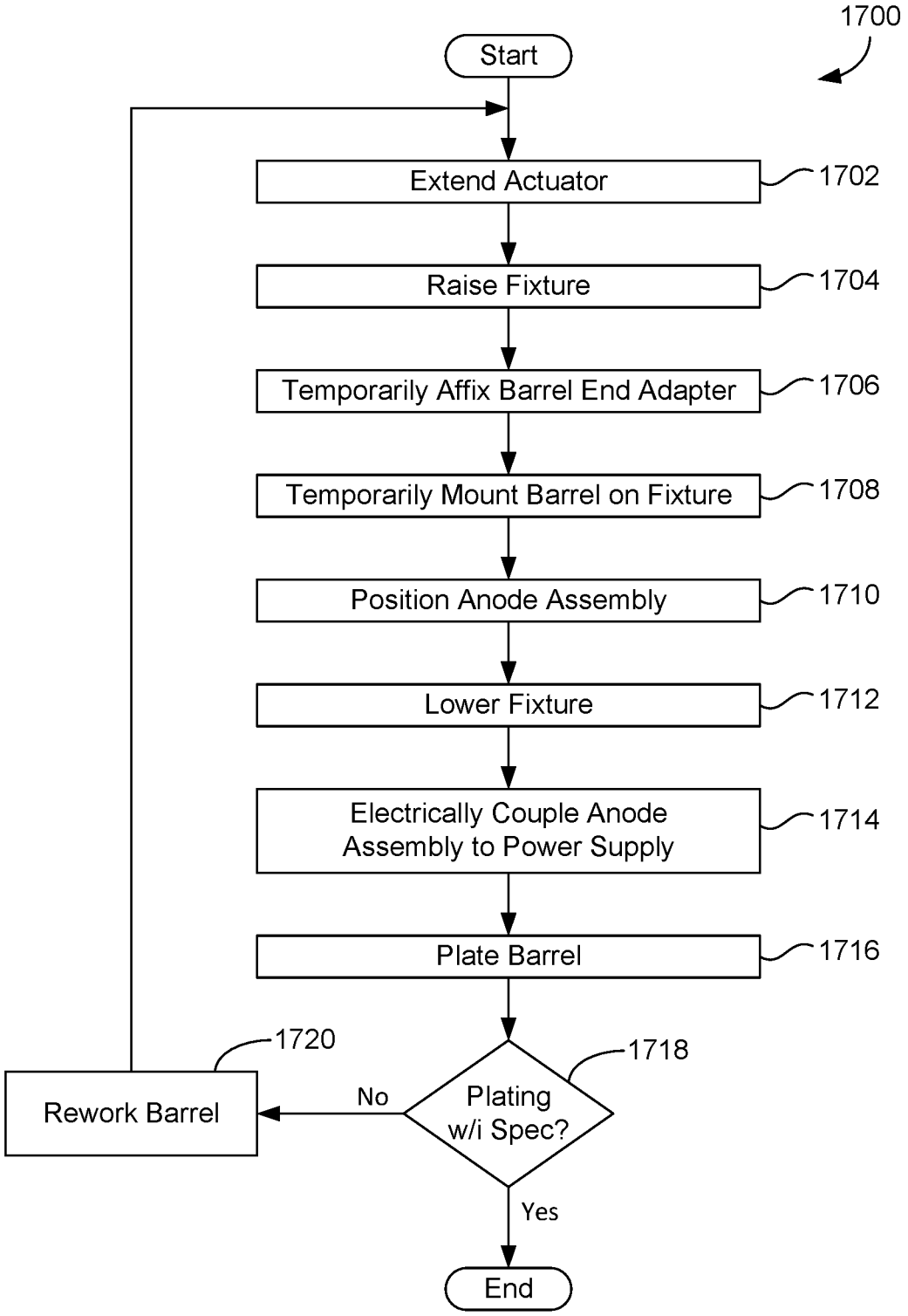
FIG. 17 is a flowchart summarizing another exemplary method for electro-processing a bore of a small-bore gun barrel.

FIG. 17 is a flowchart summarizing another exemplary method 1700 for electro-processing (plating here) a bore of a gun barrel according to the present invention. In a first step 1702, an actuator of an electro-plating fixture is extended. In a second step 1704, the fixture is raised above the plating tank to facilitate barrel loading. In a third step 1706, a barrel end adapter is temporarily affixed to an end of the barrel, and in a fourth step 1708, the barrel is temporarily mounted to the fixture. Prior to mounting the barrel end adapter and mounting the barrel, the bore of the barrel can be electro-cleaned (electro-polished), rinsed with clean water, and dried. In a fifth step 1710, an anode assembly attached to a lead is threaded through the bore of the barrel and barrel end adapter, and the lead is secured to a portion of the fixture that is movable by the actuator. In a sixth step 1712, the fixture is lowered such that the barrel is submerged in the plating solution in the plating tank. In a seventh step 1714, the anode assembly and barrel are electrically coupled to a power supply. In an eighth step 1716, the bore of the barrel is electro-plated by supplying process current to the anode assembly as the anode assembly is drawn through the bore by movement of the actuator. When plating is complete, in a ninth step 1718, the barrel is removed from the fixture (e.g., by raising the fixture again) and the bore is checked (e.g., via air gauge measurement, etc.) to determine if the plating conforms to predetermined specifications for thickness and uniformity. If it conforms, then method 1700 ends. However, if the plating is not within specifications (e.g., military standards, etc.), then in a tenth step 1720, the plating is removed from the barrel and the barrel is plated again. In view of the various features of the invention discussed herein, however, the occurrence of plating that does not conform to such specifications is significantly reduced.

As will be apparent in view of the foregoing disclosure, the electro-processing systems and methods described herein are very versatile. While the foregoing figures have been described with respect to electro-plating, it should be understood that the systems and method described herein can also be used to electropolish the bores of gun barrels (e.g., as a pre-cleaning process prior to chrome plating, etc.) wherein material is ablated from the surface of bore 204. As yet another example, the electroplating processes and systems disclosed herein can be used to plate other materials than chromium.

The present invention is particularly advantageous in electroplating small-bore gun barrels because the rate of plating adjacent the anode assembly can be controlled by varying the rate at which the anode assembly is pulled through the bore 204. The uniformly applied plating preserves the rifling profile through the bore, ensures an accurate barrel 102, and produces a finish to military specification, which significantly reduces the number of barrels that need to be reworked. However, it should be understood that the systems and methods disclosed herein can be used to electro-process other tubes having small inner diameters.

Indeed, while exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method for electro-processing a bore of a gun barrel, said method comprising:

providing a gun barrel having a bore defining an axis;

providing an electrode having a lead electrically coupled thereto, a length of said electrode being less than a length of said bore;

providing a barrel end adapter defining a conduit therethrough;

temporarily affixing said barrel end adapter to a first end of said gun barrel such that said conduit is axially aligned with said bore;

positioning said electrode within said bore;

positioning said gun barrel in electro-processing solution;

moving said electrode within at least one of said bore and said conduit; and applying process current via said electrode during said step of moving said electrode to cause electro-processing of said bore.

2. The method of claim 1, wherein:

said barrel end adapter is threaded; and said step of affixing said barrel end adapter on said gun barrel comprises screwing said barrel end adapter onto complementary threads of said gun barrel.

3. The method of claim 1, wherein said step of positioning said electrode within said bore comprises passing said lead through said bore and said conduit.

4. The method of claim 3, wherein said step of applying said process current results in said bore being electroplated.

5. The method of claim 3, wherein:

said step of providing said electrode comprises providing an electrode having a bore guide coupled thereto; and said step of positioning said electrode within said bore further includes positioning said bore guide within said bore.

6. The method of claim 5, wherein said step of providing said electrode having said bore guide coupled thereto comprises affixing said bore guide to said electrode prior to said step of positioning said electrode within said bore.

7. The method of claim 6, wherein:

said bore guide comprises a passage formed therein; and said step of affixing said bore guide to said electrode comprises positioning said electrode and said lead within said passage.

8. The method of claim 1, further comprising determining an amount of electro-processing to be applied to said bore by measuring a diameter of said bore.

9. The method of claim 8, wherein said step of moving said electrode includes controlling the rate at which said electrode is moved within said bore based on said amount of electro-processing to be applied to said bore.

10. The method of claim 1, further comprising:

moving said electrode at a first rate within a first region of said bore; and moving said electrode at a second rate within a second region of said bore, said second rate being slower than said first rate.

11. The method of claim 10, wherein:

said step of applying said process current causes said bore to be electroplated; and plating applied to said bore in said second region is thicker than plating applied to said bore in said first region.

12. The method of claim 11, wherein said second region is located near a muzzle end of said gun barrel.

13. The method of claim 1, further comprising:

providing a non-conductive processing shield configured to cover a portion of said gun barrel to prevent electro-processing of said covered portion; and positioning said processing shield within said gun barrel.

14. The method of claim 13, wherein:

said gun barrel comprises a barrel extension affixed to a second end thereof; and said step of positioning said processing shield within said gun barrel comprises covering an inner surface of said barrel extension with said processing shield.

15. The method of claim 1, further comprising:

providing a second gun barrel having a bore defining an axis;

providing a second electrode having a lead electrically coupled thereto, a length of said second electrode being less than a length of said bore of said second gun barrel;

providing a second barrel end adapter defining a conduit therethrough;

affixing said second barrel end adapter to a first end of said second gun barrel such that said conduit of said second barrel end adapter is axially aligned with said axis of said bore of said second gun barrel;

positioning said second electrode within said bore of said second gun barrel;

positioning said second gun barrel in said electro-processing solution;

moving said second electrode within said bore of said second gun barrel and said conduit of said second barrel end adapter; and applying second process current on said second electrode during said step of moving said second electrode to cause electro-processing of said bore of said second gun barrel.

16. The method of claim 15, wherein said step of moving said electrode and moving said second electrode comprises moving said electrode and said second electrode at different rates.

17. The method of claim 15, wherein said process current and said second process current facilitate equal current densities.

18. The method of claim 1, wherein said step of moving said electrode within at least one of said bore and said conduit comprises rotating said electrode as said electrode moves within said bore.

* * * * *